US011426001B1

(12) United States Patent
Tolbert

(10) Patent No.: US 11,426,001 B1
(45) Date of Patent: Aug. 30, 2022

(54) COLLAPSIBLE CHAIR

(71) Applicant: John Tolbert, Jacksonville, FL (US)

(72) Inventor: John Tolbert, Jacksonville, FL (US)

( * ) Notice: Subject to any disclaimer, the term of this patent is extended or adjusted under 35 U.S.C. 154(b) by 0 days.

(21) Appl. No.: 17/386,710

(22) Filed: Jul. 28, 2021

(51) Int. Cl.

| | |
|---|---|
| ***A47C 16/00*** | (2006.01) |
| ***A47C 20/02*** | (2006.01) |
| ***A47C 1/00*** | (2006.01) |
| ***A47C 1/14*** | (2006.01) |
| ***A47C 4/04*** | (2006.01) |
| ***A47C 7/74*** | (2006.01) |
| ***A47C 7/62*** | (2006.01) |

(52) U.S. Cl.
CPC ..... *A47C 4/04* (2013.01); *A47C 7/622* (2018.08); *A47C 7/744* (2013.01)

(58) Field of Classification Search
CPC ..... A47C 1/146; A47C 4/04; A47C 4/00
See application file for complete search history.

(56) References Cited

U.S. PATENT DOCUMENTS

| | | | | |
|---|---|---|---|---|
| 3,292,189 | A * | 12/1966 | Parker | A47C 1/146 5/656 |
| 3,692,358 | A | 9/1972 | Sung | |
| 3,722,952 | A | 3/1973 | Novitzky | |
| 4,410,214 | A | 10/1983 | Geschwender | |
| 4,973,034 | A | 11/1990 | Michele | |
| 5,059,476 | A | 10/1991 | Steinger | |
| 5,425,567 | A | 6/1995 | Albecker, III | |
| 5,752,743 | A | 5/1998 | Garelik | |
| 5,836,653 | A | 11/1998 | Albecker | |
| 5,913,572 | A | 6/1999 | Grimaldi | |
| 6,036,262 | A | 3/2000 | Shahid | |
| 6,250,712 | B1 * | 6/2001 | Livington | A47C 1/146 5/632 |
| 7,185,948 | B2 | 3/2007 | Liu | |
| 7,628,450 | B2 | 12/2009 | Castanolga | |
| 8,033,612 | B2 | 10/2011 | Smith | |
| 8,038,221 | B2 | 10/2011 | Smith | |
| 8,578,526 | B1 * | 11/2013 | Rosso | A47C 1/146 5/632 |
| 8,714,643 | B2 | 5/2014 | Obolewicz | |
| 9,204,725 | B2 * | 12/2015 | Kania | A47C 1/146 |
| 9,345,330 | B2 | 5/2016 | Andrade | |
| 9,596,938 | B2 | 3/2017 | Lee | |
| 9,854,912 | B2 | 1/2018 | Iocabucci | |
| 9,888,776 | B2 | 2/2018 | Brandhuber | |
| D902,619 | S * | 11/2020 | Chen | D6/375 |
| 10,986,929 | B2 * | 4/2021 | Levin | A47C 1/146 |
| 2009/0015040 | A1 * | 1/2009 | Redmann | A47C 7/008 297/16.1 |
| 2010/0176639 | A1 * | 7/2010 | Balgaard | A47C 7/666 297/354.13 |
| 2014/0210238 | A1 * | 7/2014 | Kania | A47C 3/029 280/47.33 |

* cited by examiner

*Primary Examiner* — Shin H Kim
(74) *Attorney, Agent, or Firm* — Lawrence J. Gibney

(57) ABSTRACT

This invention will provide a lightweight, portable device which will be adjustable and can be used outdoors in all types of environments. The device can be configured into multiple shapes for extra utility while the device is used. For instance, the user can lie flat on the device as well as form the device into a chair. Other features that may be incorporated into the device include a storage compartment, a cell phone compartment, and an air conditioner and the ability for more than one person to use the device. In some of the embodiments the device can be used by two people.

7 Claims, 31 Drawing Sheets

COLLAPSIBLE CHAIR

FIELD OF THE INVENTION

This device is a foldable portable mat that can transform into a chair which a person could take to the beach, a park, or any other recreational spot as desired. There are multiple embodiments to this device and it is designed to be lightweight, portable and comfortable.

PRIOR ART

This device is a collapsible chair and there are many other prior art references to chairs in general and chairs that collapse or fold. However, none of the prior art teach all the features in this particular application.

For instance, a representative example in the prior art can be found at Brandhuber, U.S. Pat. No. 9,888,776, which is seated, reclining furniture. While the current device reclines, it can be placed directly on the ground surface or be formed into a chair that is off the ground. These features are not taught or contemplated by Brandhuber.

Another example in the prior art can be found at Castagonola, U.S. Pat. No. 7,628,450. This reference is a collapsible chair. However, it does not have all the features of the current application. While it does collapse, it does not have, for instance, the storage compartment, or the air conditioning unit with the vents.

Another prior art reference can be found at Garelik, U.S. Pat. No. 5,752,743. This teaches folding furniture construction. Another is Geschwender, U.S. Pat. No. 4,410,214. This device rests on the ground. Unlike some of the other references, it does have some folding members for ease of portability. However, this does not have all the features of the current application.

There are many other prior art references that teach methods to fold chairs or chairs that transform into different objects. However, none of the prior art references teach all the features of the current application.

BRIEF SUMMARY OF THE INVENTION

This device is portable and lightweight but can withstand temperature extremes and all environmental conditions. The device can fold for easy carrying and can be configured into many different shapes and sizes to best accommodate the user.

There will be seven different embodiments that can be varied depending on the tastes of the user.

In the first embodiment as depicted in FIGS. 1-4, the device will have a storage compartment with a lid on one end of the device and have a seat on which the person will lie or rest against the seat material if the headrest is folded up. A balancer on the back on the opposite of the headrest will allow the chair to be tilted upwards, but the edge of the balancer will rest against the surface of the storage compartment so that once the device is tilted, it will remain in place. A pair of snap locks (male and female) will allow the device to be snapped together for easy carrying. Additionally, a seat will be provided so the person can rest comfortably while using the device.

In the second embodiment as depicted in FIGS. 5-8, there is no storage compartment but the balancer will fold to form a support that extends from the back of the device opposite the head rest. A strap to reinforce the balancer against the seat so that the device does not collapse is also provided. A plurality of square spikes will be positioned on the end of the balancer so that the balancer can be placed on many different types of surfaces including sand. This seat portion of the device will fold up to form a chair by having the seat fold into a chair on which the user can sit. On the end of the seat a lip will be provided to fold the end of the seat against the lip for stability.

The third embodiment is depicted in FIGS. 9 through 13. The third embodiment does not teach a storage compartment but incorporates a hidden cell phone compartment, as well as an embedded air conditioner unit and outflow vents to provide comfort to the user. A power source is included to provide power for the air conditioning unit and the fan that may be in the outlet vents. The seat in the third embodiment is also straight, but not foldable. The third embodiment will have a balancer, as well as square spikes on one end of the balancer, such as depicted in FIG. 9. Unlike the second embodiment a strap that attaches to the surface of the balancer from the back of the backrest and the underside of the headrest to prevent the headrest from collapsing. However, in this embodiment a section of the device is attached to the backrest and pivots away from the back surface of the backrest to provide a balancer. On one end of the balancer will be a plurality of spikes to permit the device to be used on a multitude of ground surfaces.

The fourth embodiment are depicted by FIGS. 14 through 17. The fourth embodiment will be comprised of a flat back surface (backrest) and a rigid member (balancer) on the back side of the backrest will bend and pivot away from the approximate middle of the back side of the backrest. On a portion of the back of the headrest surface the balancer will bend and will be inserted into a plurality of notches on the flat surface. The notches will allow the back surface to tilt at different angles to accommodate the user. The fourth embodiment will also incorporate an air conditioning unit and the appropriate vents. It will also incorporate the hidden cell phone compartment.

The fifth embodiment is depicted in FIGS. 18 through 22. This allows two individuals to sit on the device and the two sections will operate independently of the other so the tilt angles of the backrest and seat will depend on the comfort of the user. A balancer, which is attached to the back side of the backrest near the end of the backrest will also be provided to enable the device to be tilted for the convenience of the user. A storage compartment is not provided in the fifth embodiment. The embedded air conditioning and vents are also not provided.

The sixth embodiment is depicted as in FIGS. 23 through 26. A storage compartment to the side of the seat is provided. A balancer with the square spikes on the end of the balancer is also provided. A strap is not provided to on the back of the backrest. An air conditioning unit and vents are provided for the comfort of the user and a cell phone storage compartment is also provided.

The seventh embodiment is depicted in FIGS. 27 through 31. In the seventh embodiment a hinge is provided on the seat material so that the seat can be completely folded into a compact device. The seventh embodiment will incorporate a backrest and a balancer that will bend to provide a support for the backrest and prevent its collapse. A storage compartment is not incorporated in this embodiment. An embedded air conditioner and vents will be provided for the comfort of the user. In the seventh embodiment a first foldable member and a second foldable member on the bottom surface of the seat will fold outward as depicted in FIG. 30 to form a chair above the ground. The surface of the chair that has been created will allow the individual to allow flat or remain tilted.

NUMBERING REFERENCES

Figure 1:
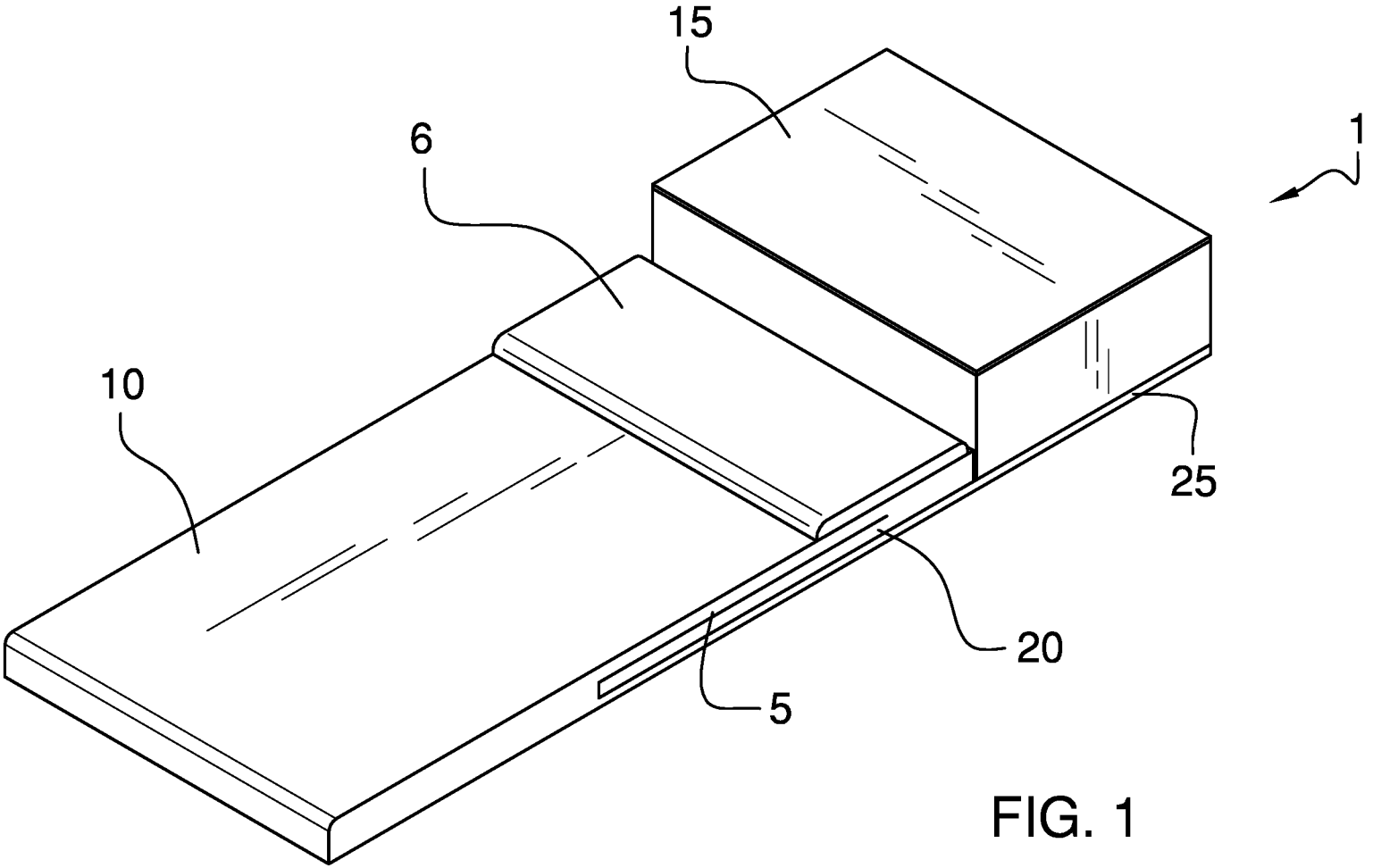
FIG. 1 is a front isometric view with the chair down in the first embodiment.

1 Device
5 Backrest
6 Headrest
10 Seat
15 Storage compartment
20 Balancer
25 Base
26 Notch
30 Snap lock male
31 Lip
35 Snap lock female
16 Lid to the storage compartment
40 Strap
45 Square spikes
50 Hidden cell phone compartment
55 Snap lock male
56 Snap lock female
60 Outflow vents
70 Hinge
75 First Foldable Section
80 Air Conditioning unit
85 Second Foldable Section

DETAILED DESCRIPTION OF THE EMBODIMENTS

This device is designed to be portable and easily folded and carried as a flat piece to the beach, park, or other recreational area. It is designed to be lightweight and is made of material that can withstand all environmental conditions. The material is designed to be comfortable to the user and can be custom fit to the individual contours of the person. It will be comprised of seven total embodiments and each embodiment will have common features. The device is used as a piece of recreational equipment on which a person can lie flat or reclined. In one of the embodiments the device can also be formed into a chair.

First Embodiment

The first embodiment is depicted by FIGS. 1 through 4. At one end on the bottom will be a base 25 will extend the entire length of the device. On the top portion of the base a storage compartment 15 with a lid 16 will be provided. This storage compartment is integrated with the base and will be used to store commonly used items that a person may take to the beach or park. The storage compartment may be locked.

Figure 2:
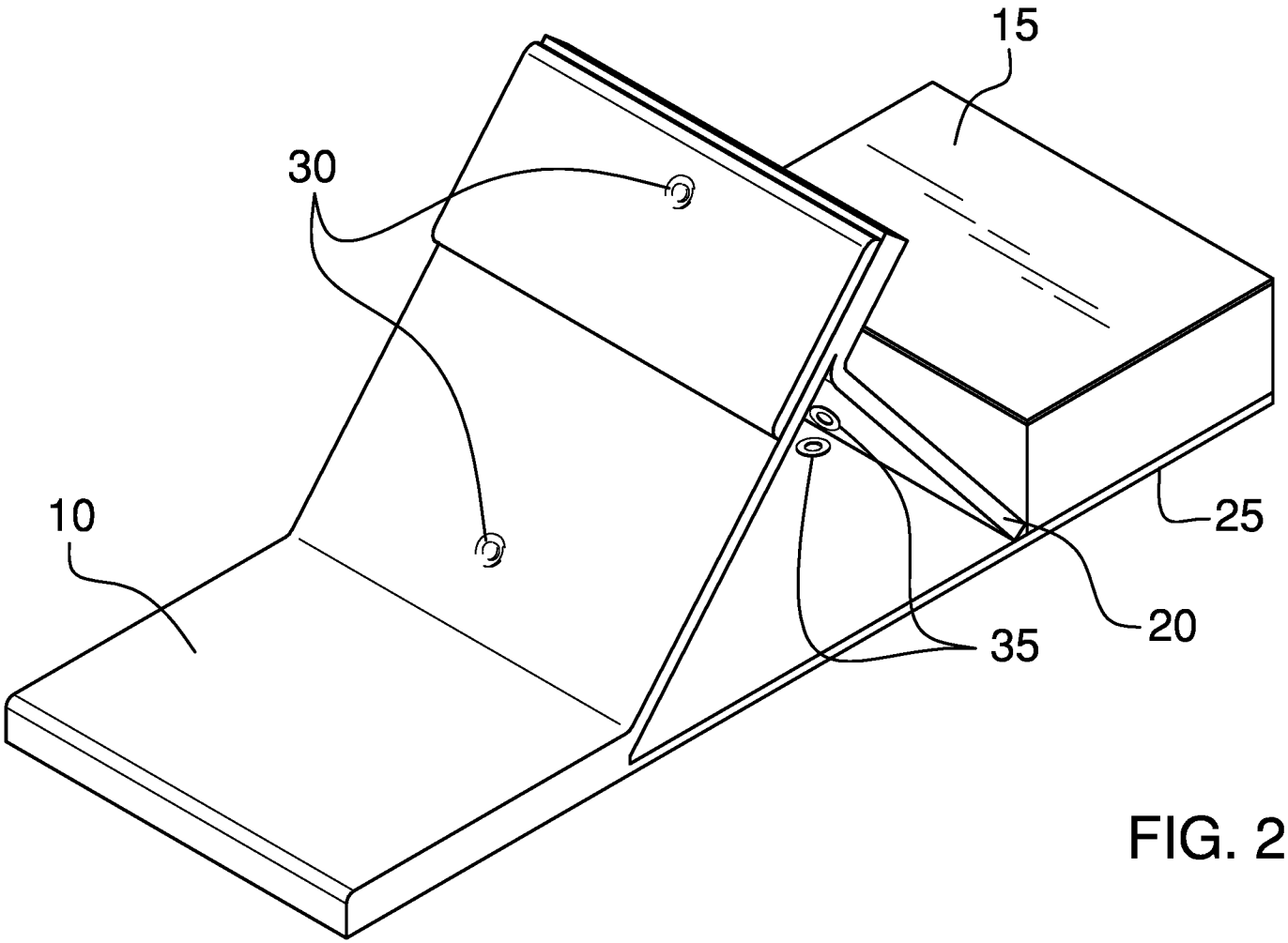
FIG. 2 is a front isometric view with the chair up in the first embodiment.
Figure 3:
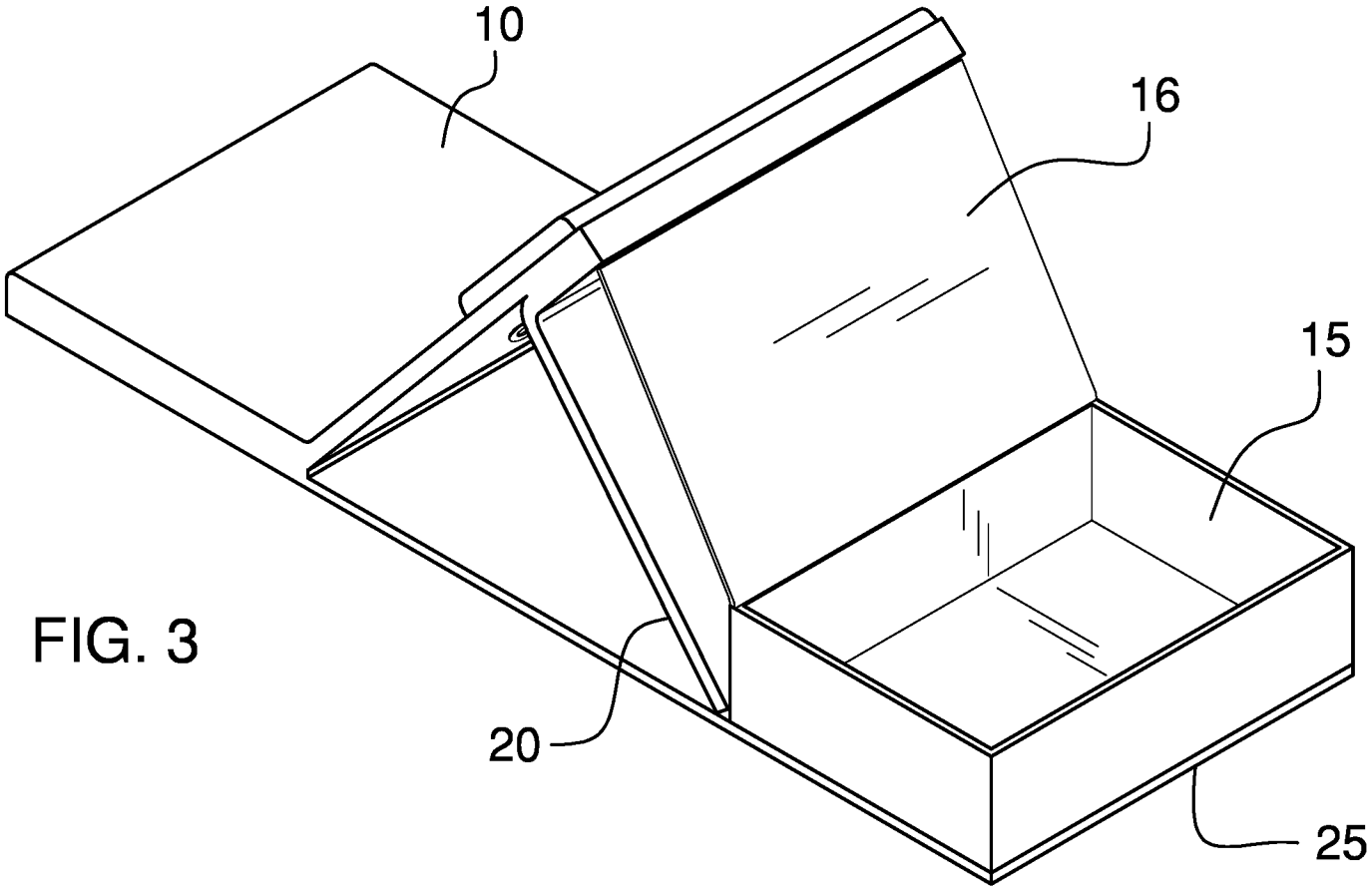
FIG. 3 is a back isometric view with the chair up in the first embodiment.
Figure 4:
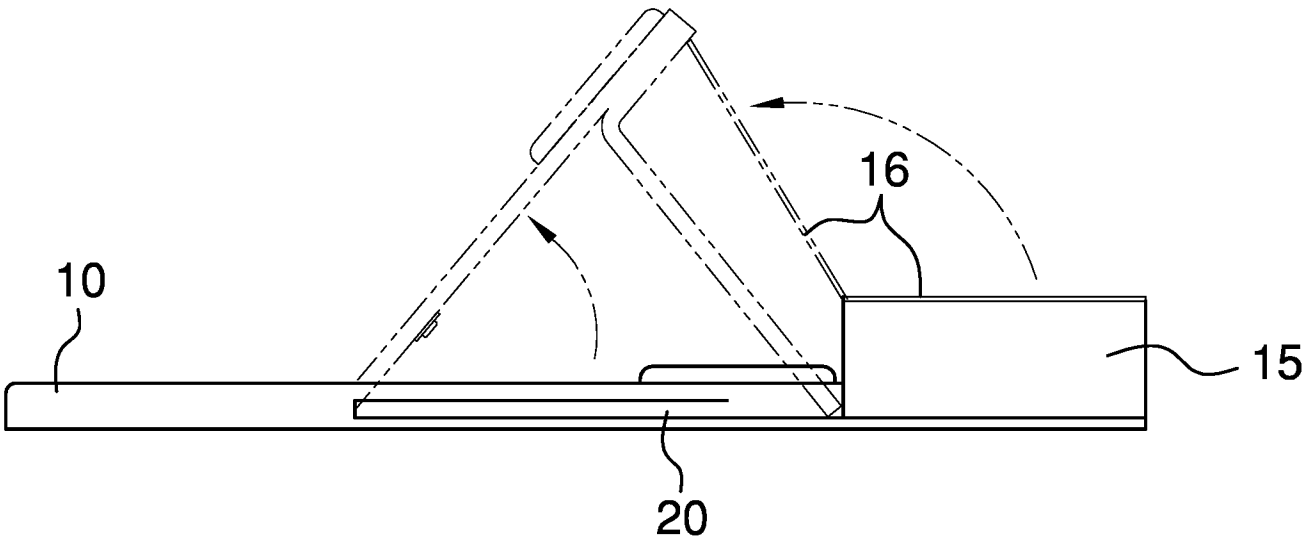
FIG. 4 is a side view showing the seat in the closed position in the first embodiment.

On the portion furthest from the storage compartment 15 will be the seat 10. The seat will be made from comfortable material and the person will like flat or inclined against the seat material. On one end of the seat a headrest 6 will be provided for the comfort of the user. The seat is not rigid and may be folded such as depicted in FIGS. 2 and 3. The headrest 6 and seat 5 will be made of special made material that will enable comfort and a material that will retain memory for the user.

A balancer 20 which is placed on the underside of the surface for the headrest will fold such as depicted in FIG. 2. The balancer will be sturdy enough to support the weight of an individual as the individual partially reclines on the device. One end of the balancer will be placed against the edge of the surface of the storage compartment for stability; the lid 16 of the storage compartment may fold upward and rest against the back surface of the headrest for additional support such as depicted in FIG. 3.

A pair of male snap locks 30 and a corresponding pair of female snap locks 35 will be provided on the back rest and underside of the headrest to allow the device to be secured and prevent the item from unfolding when the person is carrying the item.

Second Embodiment

Figure 5:
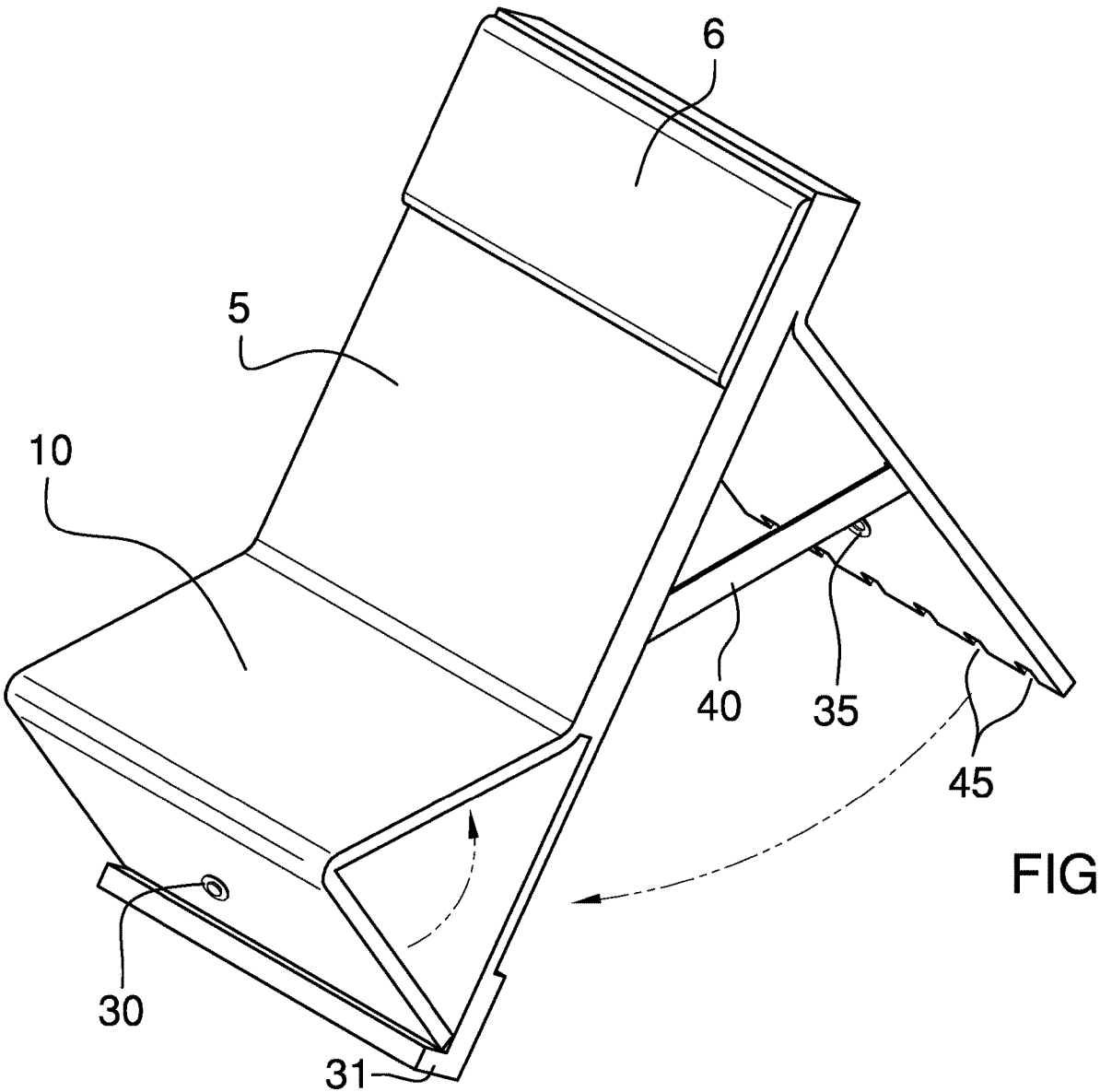
FIG. 5 is a front isometric view of an alternative embodiment in the second embodiment.
Figure 6:
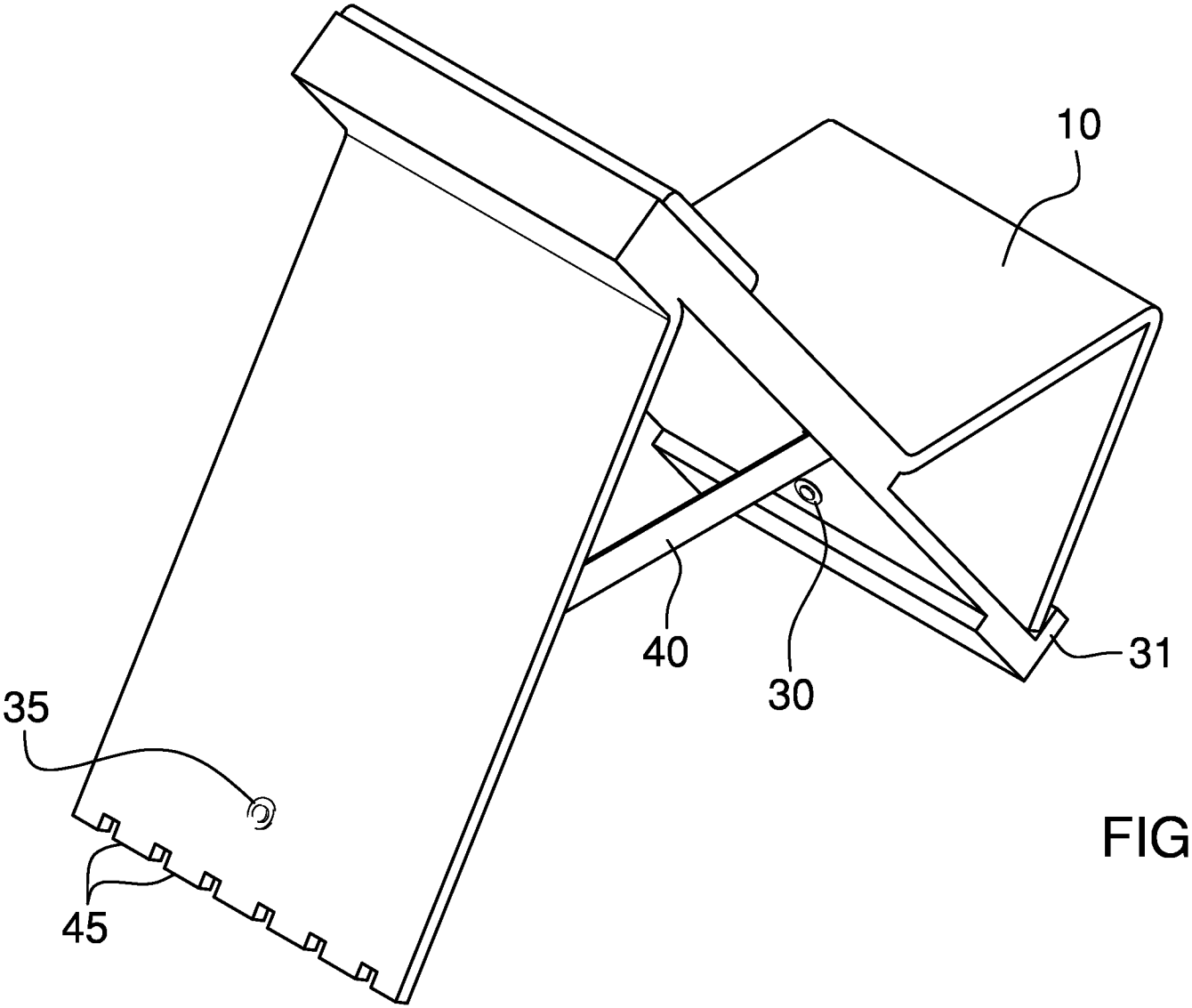
FIG. 6 is a back isometric view of the alternative of the second embodiment.
Figure 7:
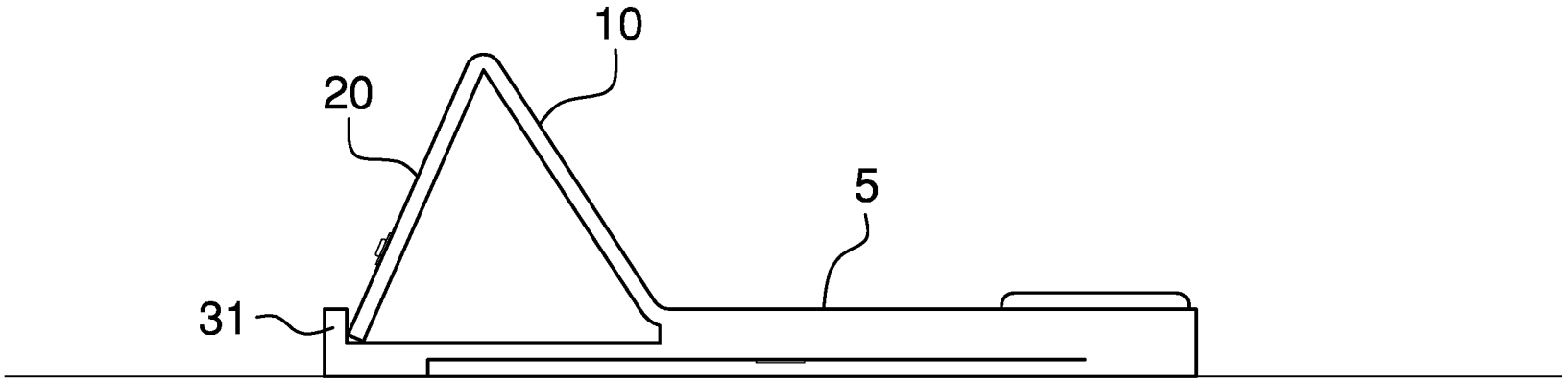
FIG. 7 is a side view in an alternate position in the second embodiment.

A second embodiment, which is depicted in FIGS. 5 through 8, uses the same type of material as the first embodiment but can fold into a seat where the person's legs are bent. It will still have a backrest 5 and a headrest 6. The seat 10 will fold to form a chair, such as depicted in FIG. 5. The base 25 will extend a predetermined length when the device does not take the shape of a chair as depicted in FIG. 7. On one end of the base a lip 31 that is semi-rigid will extend a determined vertical distance and will provide surface upon which the end of the seat will be placed to form the chair 10. On the underside of the base opposite the headrest 6 will be a balancer 20 that will fold backward to form the structure for the chair.

Additionally, a strap 40 on the back surface of the backrest will connect with the balancer 20 which has square spikes 45. The square spikes will enable the device to be able to grip more surfaces to keep the device upright on any surface. A strap 40 will also provide needed rigidity.

Figure 8:
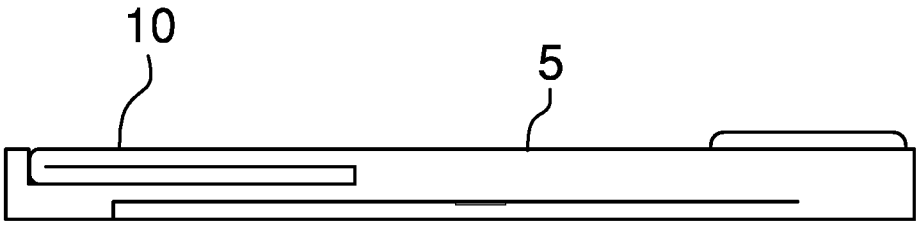
FIG. 8 is a side view of the closed position in the second embodiment.
Figure 9:
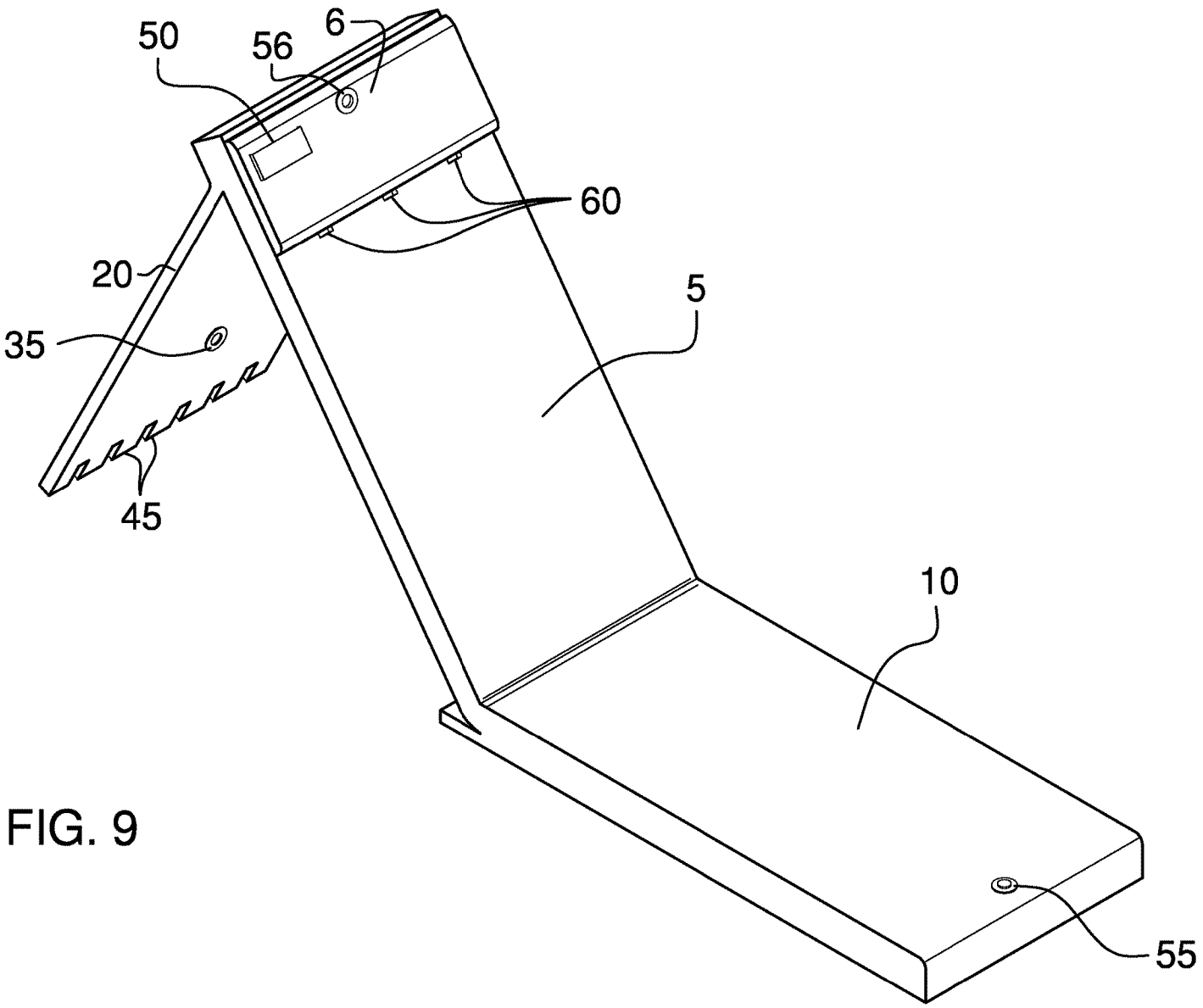
FIG. 9 is a front isometric view of the third embodiment.
Figure 10:
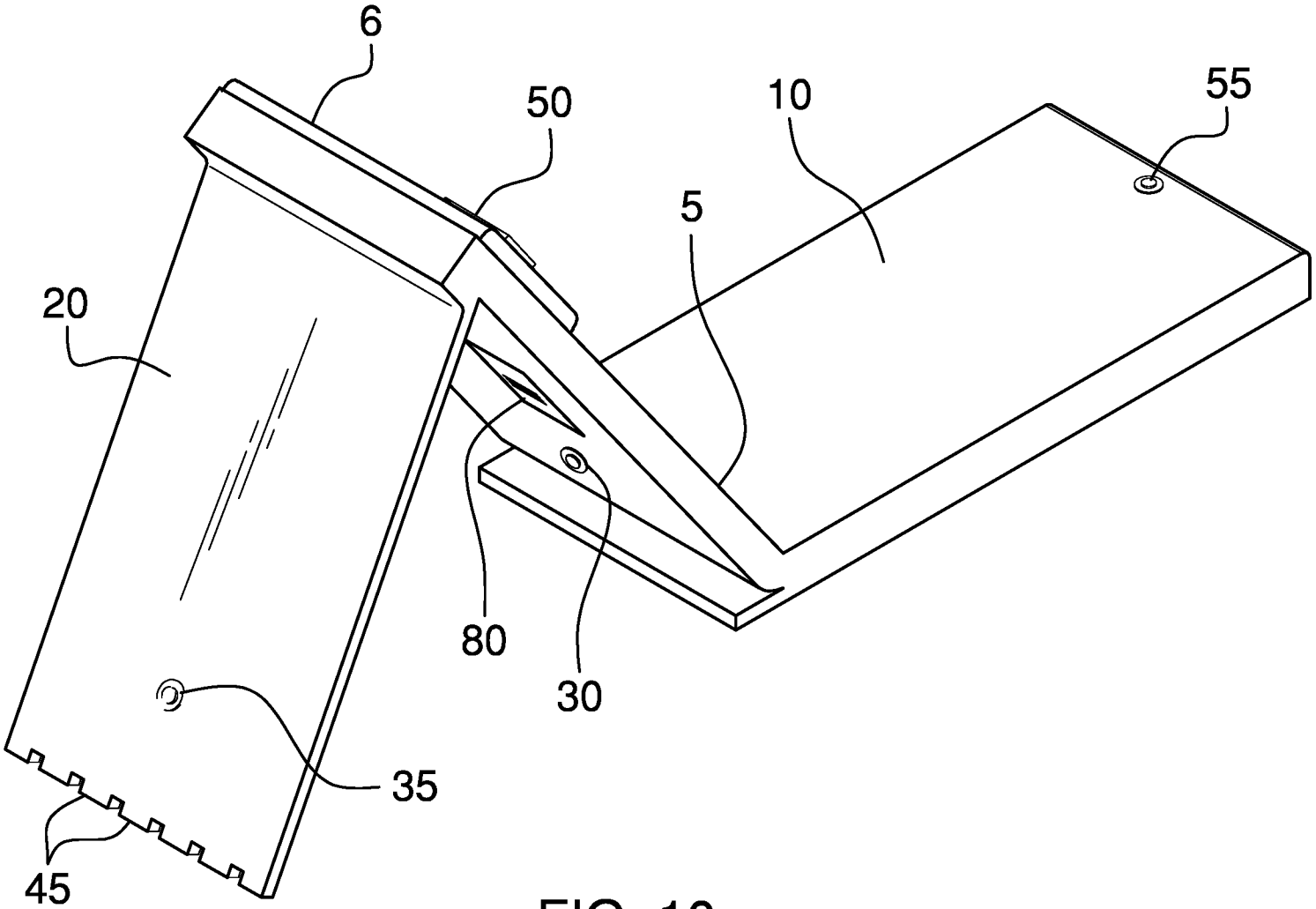
FIG. 10 is a back isometric view of the third embodiment.
Figure 11:
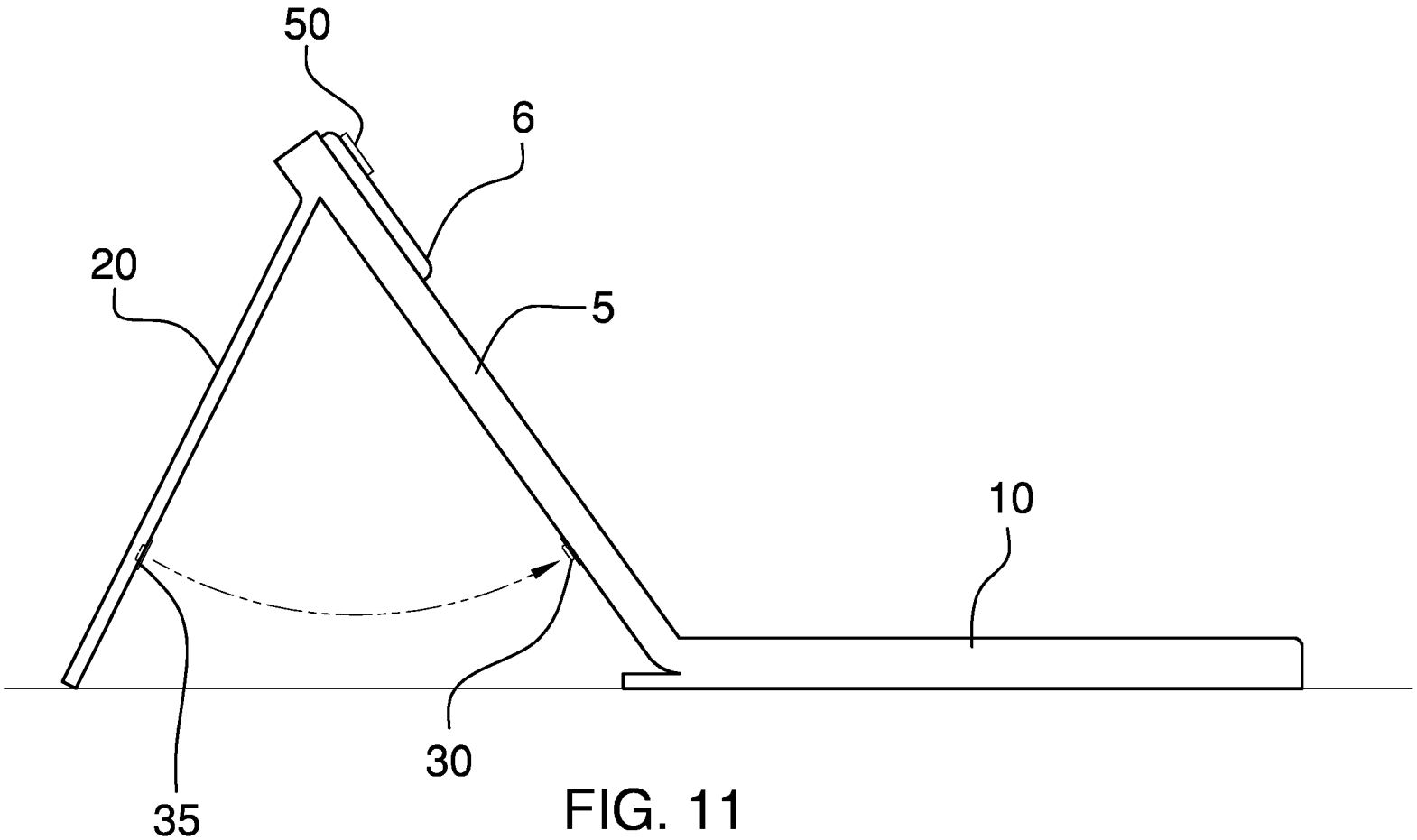
FIG. 11 is a side view of the third embodiment.
Figure 12:
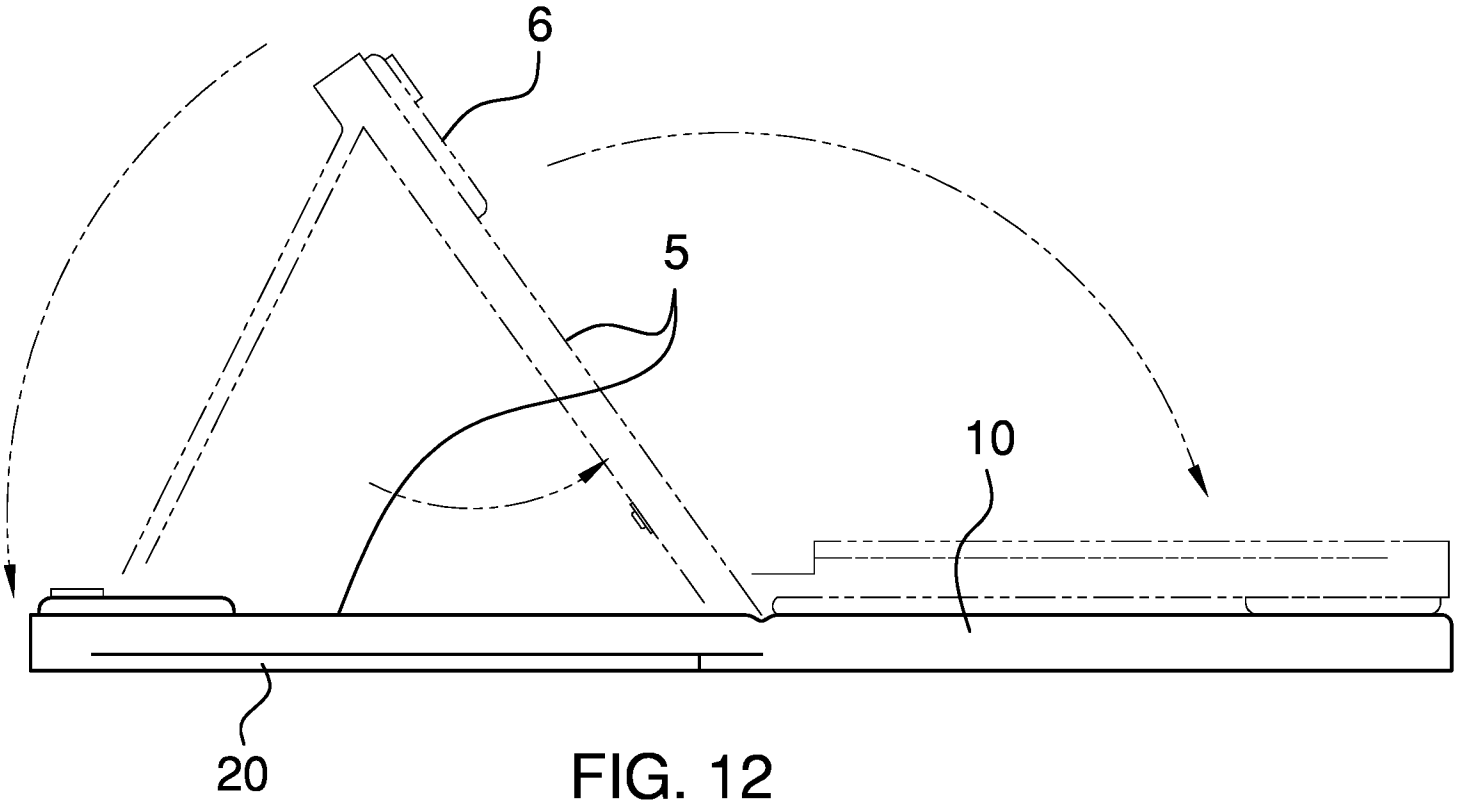
FIG. 12 is a side view showing the seat in a closed position in the third embodiment.
Figure 13:
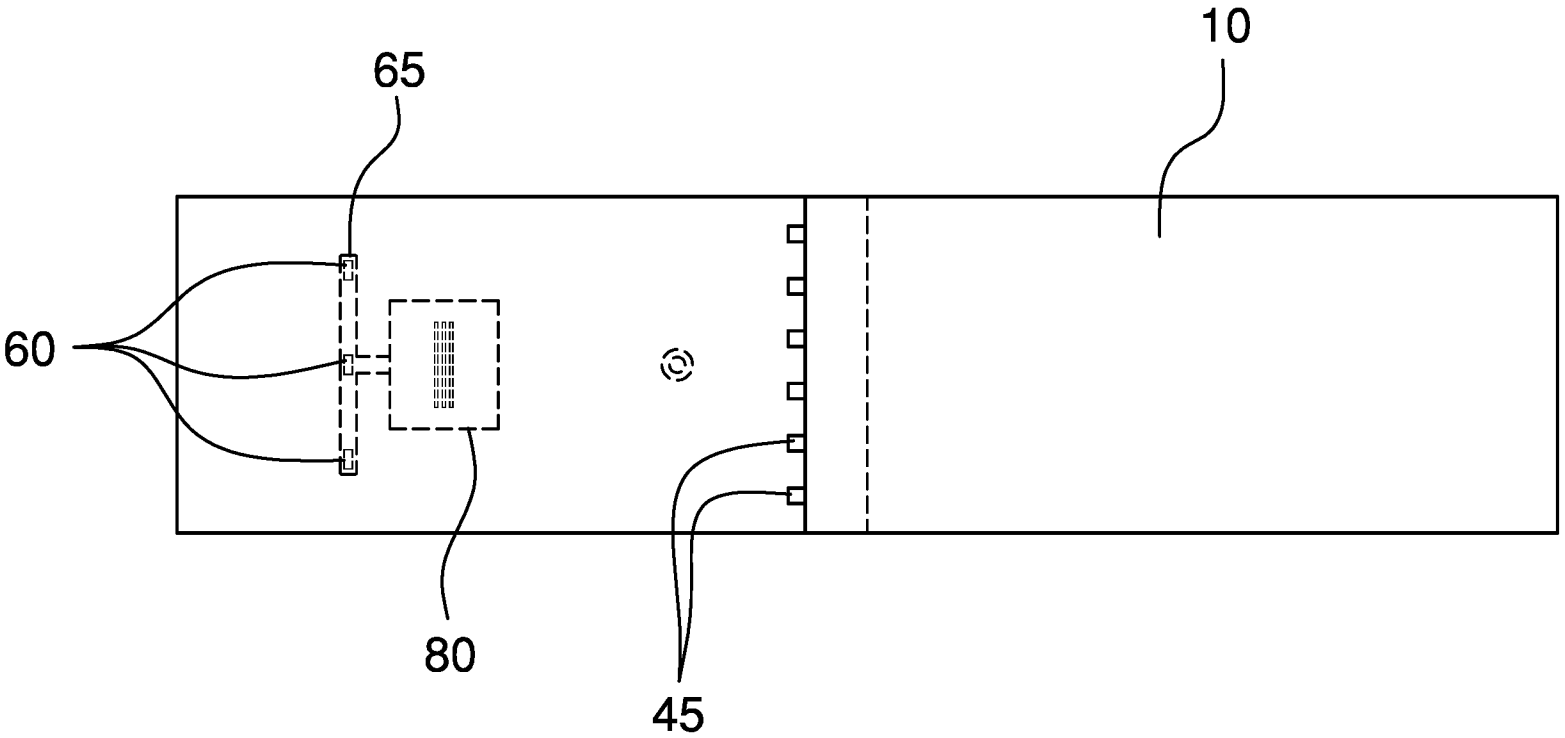
FIG. 13 is a back view of the third embodiment showing the seat with a balancer closed.

When the device is carried a male snap lock 30 and a female snap lock 35 will be used when the device is carried, such as depicted in FIG. 8 of the device is in the closed position.

Third Embodiment

The third embodiment is depicted in FIGS. 9 through 12. The backrest 5 and seat 10 will be a predetermined length. A cell phone compartment 50 will be placed on the headrest 6.

A snap lock 55 will be on the front service of the seat 10 will mate with a female lock 56 to carry the item. Although snap locks are described in this application other means to secure the device may also be used.

The person would lay his or her head against a headrest 6 and a corresponding female snap lock 56 would be on the top of the headrest which will snap with the snap lock on the front of the seat for use during carrying.

The balancer 20 is an integral part of the device and will be placed behind the headrest and will flex backwards to form a foundation on which the device can rest. A female snap lock 35 will be secured to a male snap lock 30 on the back side of the backrest 5.

A plurality of square spikes 45 will also be used to enable the device to grip the surface of any type of terrain.

An air conditioning unit 80 which may be powered in a variety of ways will be embedded into the backrest and a plurality of outflow vents 60 from the air conditioner will be positioned on the surface of the headrest to provide some temperature control for the user and he or she lies on the device. A power source will be provided and possible power sources may include solar power, alternating current or direct current.

Fourth Embodiment

Figure 14:
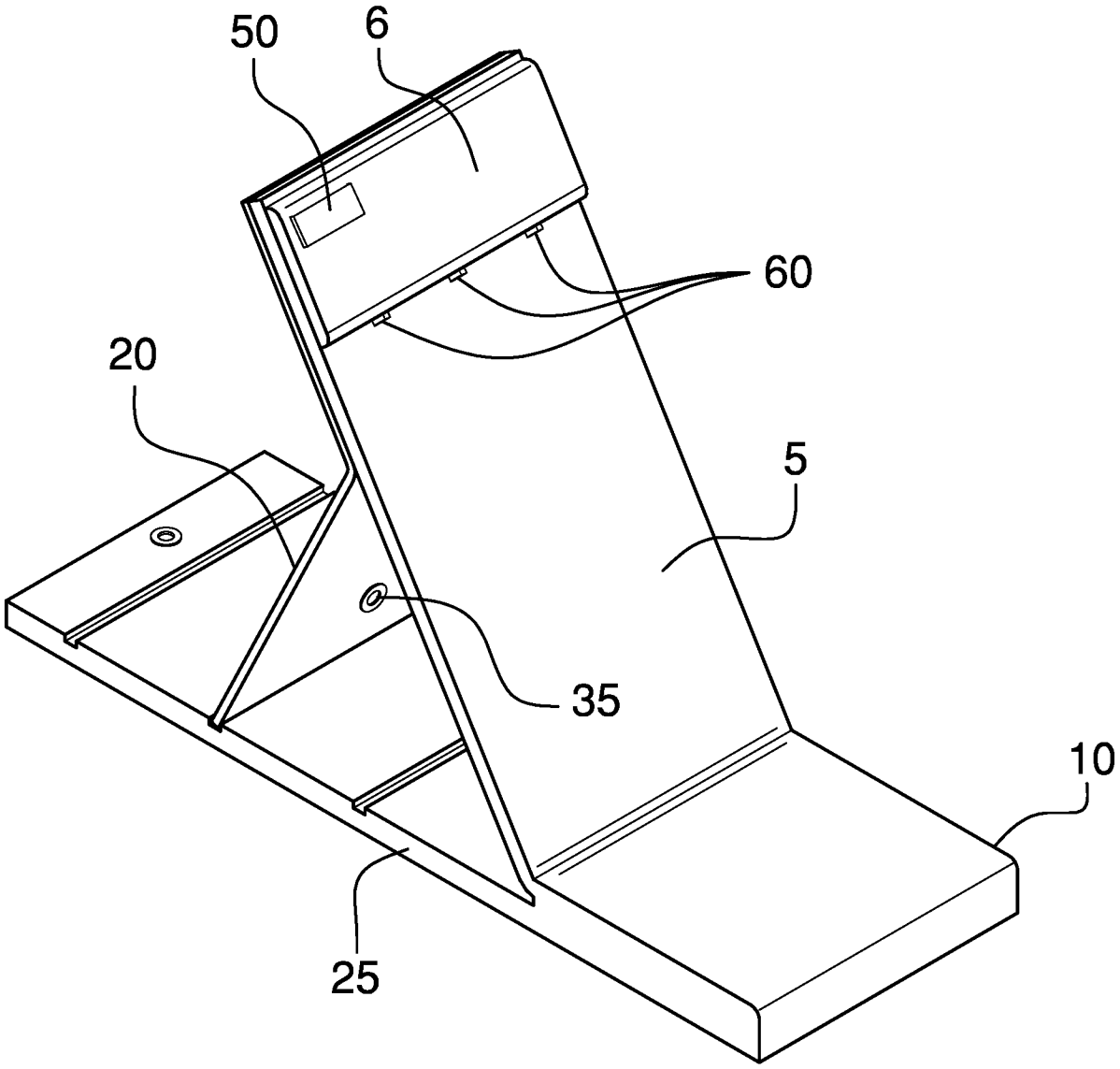
FIG. 14 is a front isometric view of the fourth embodiment.
Figure 15:
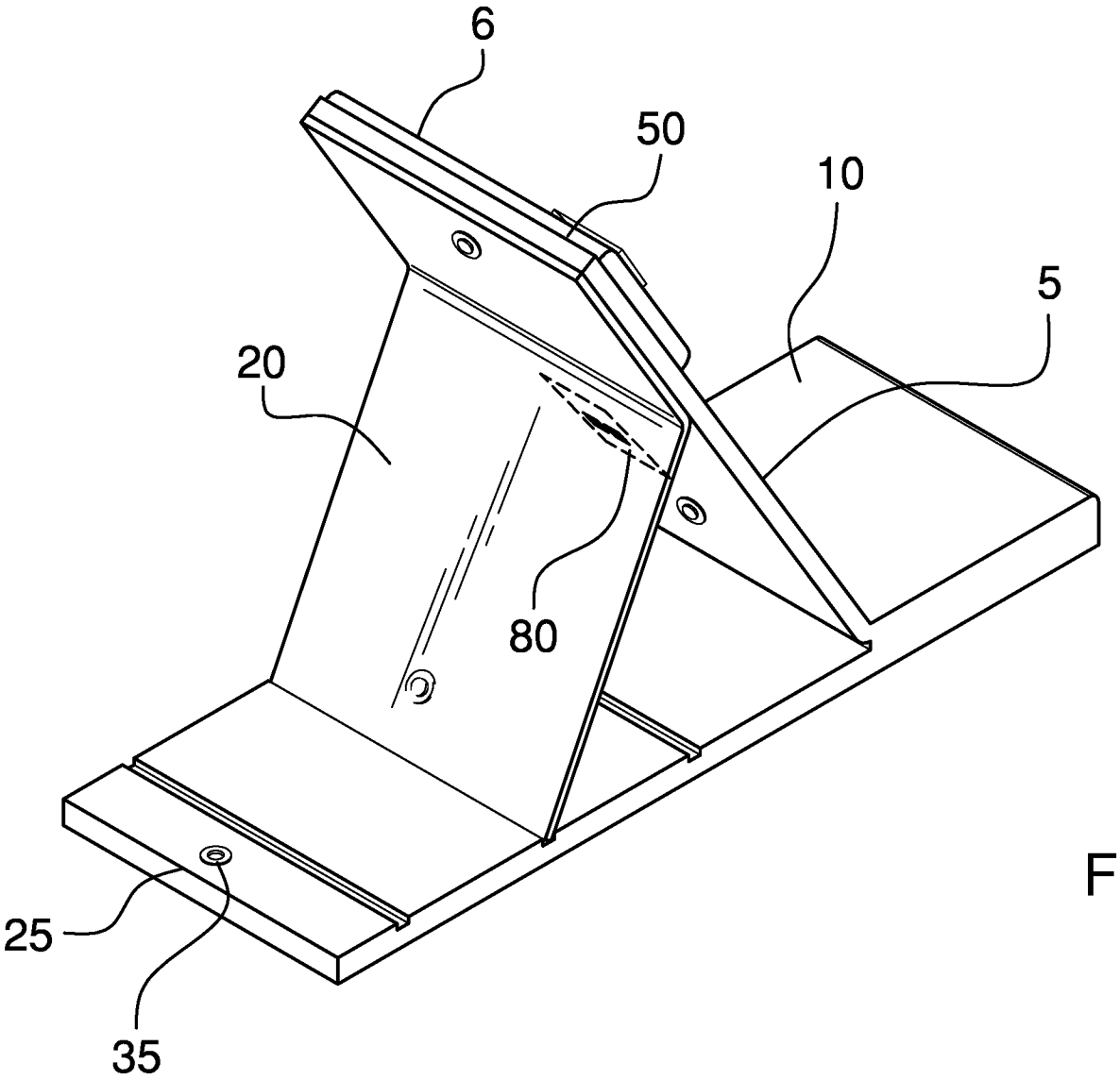
FIG. 15 is a back isometric view of the fourth embodiment.
Figure 16:
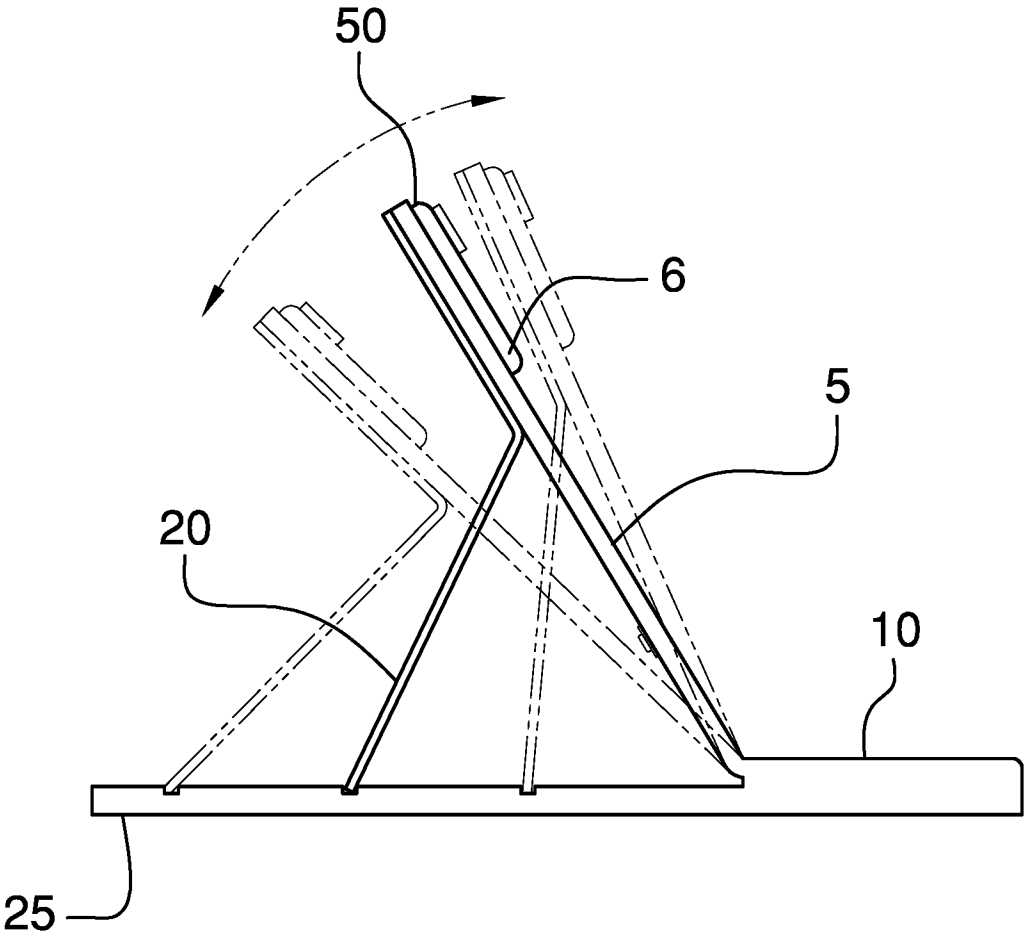
FIG. 16 is a side view showing different backrest positions of the fourth embodiment.
Figure 17:
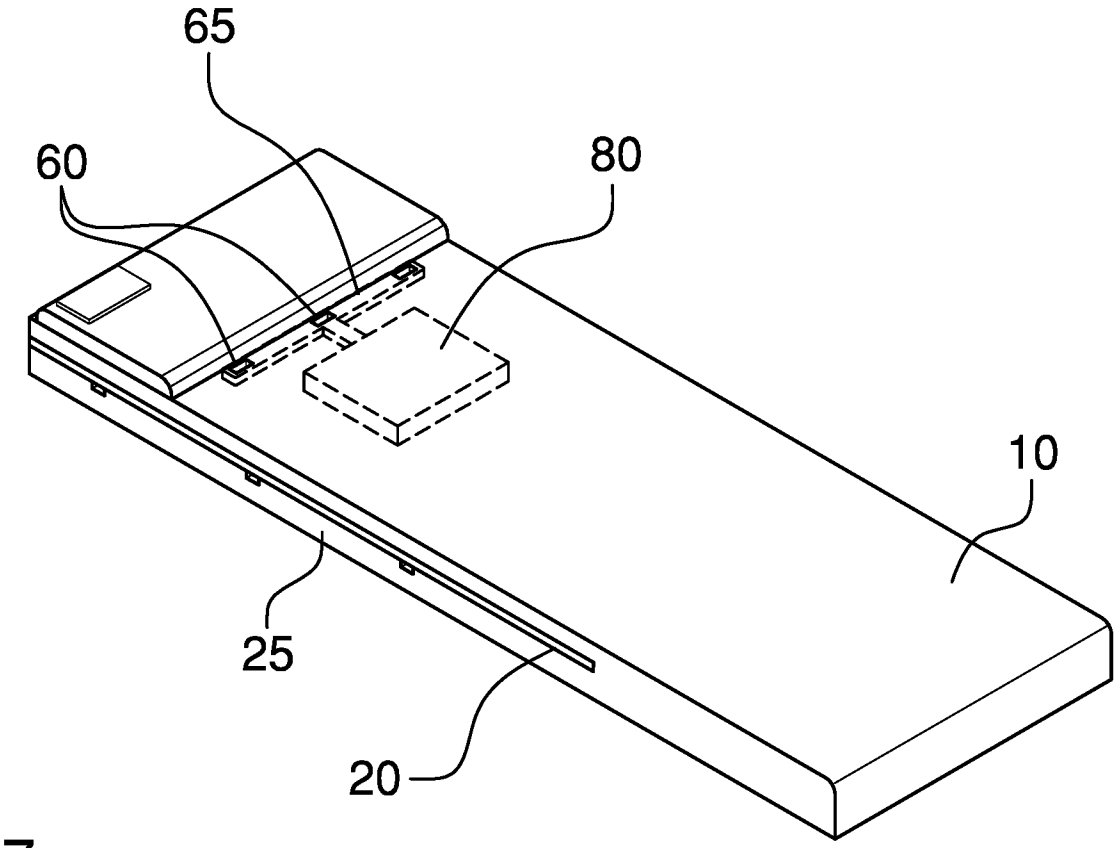
FIG. 17 is a front isometric view in the closed position of the fourth embodiment.

The fourth embodiment is depicted in FIGS. 14 through 17. The base 25 is a flat member with a first end and a second end. At the end of the first end is a seat 10 and a headrest 6 is at the second end. A backrest 5 is positioned between the seat 10 and headrest 6. The portion of the mat between the backrest 5 and the seat is flexible to provide an inclined surface upon which a person can recline such as depicted in FIG. 14.

A balancer 20 is placed on the opposite surface of the backrest 5 in the approximate middle of the backrest 5; the balancer is also flexible and can be bent away from the back surface of the headrest at a variety of angles. On the base member a plurality of notches 26 are provided. The end of the balancer 20 will be placed in the respective notch 26 to provide the desired incline of the backrest. Three notches are depicted on FIG. 14 but more or less notches can be provided depending on the desires of the customer.

On the back surface of the backrest an air conditioner unit 80 will be provided. A power source will also be provided. Possible power sources may include solar power, alternating current or direct current. The placement of the air conditioning unit 80 will be positioned such that it is placed with the comfort of the user in mind. Outflow vents 60 will connect the air conditioner unit to the device. A cell phone compartment 50 will also be provided on the headrest 6.

A plurality of male snap locks 55 and female snap locks 56 are provided to allow the easy transport of the device and prevent the device from unfolding during transport.

Fifth Embodiment

A fifth embodiment is depicted by FIGS. 18 through 22. The fifth embodiment teaches a base 25 that is made of the same material as the other four previously described embodiments. The base member will be a predetermined shape that can accommodate two individuals.

Figure 18:
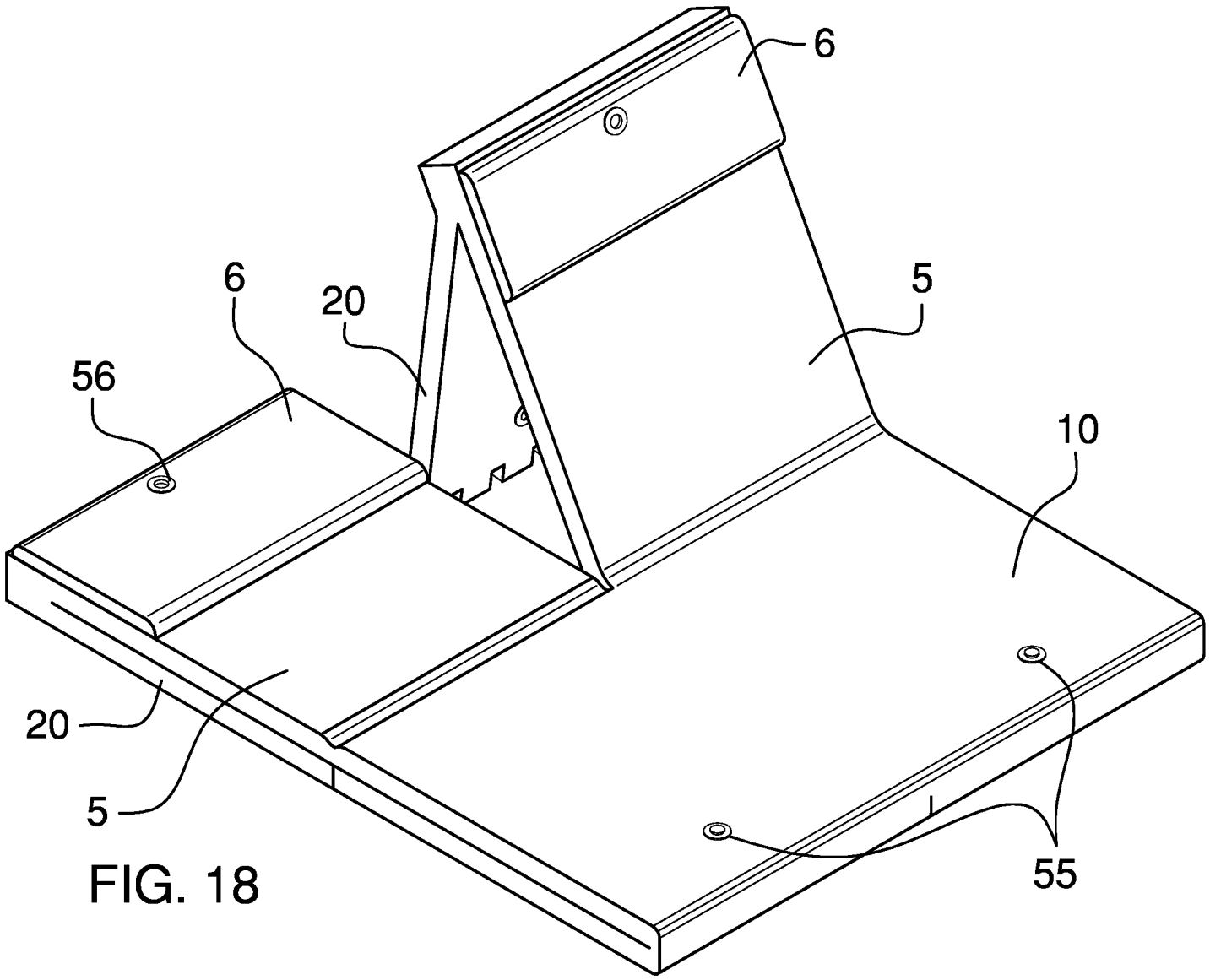
FIG. 18 is a front isometric view of the fifth embodiment.
Figure 19:
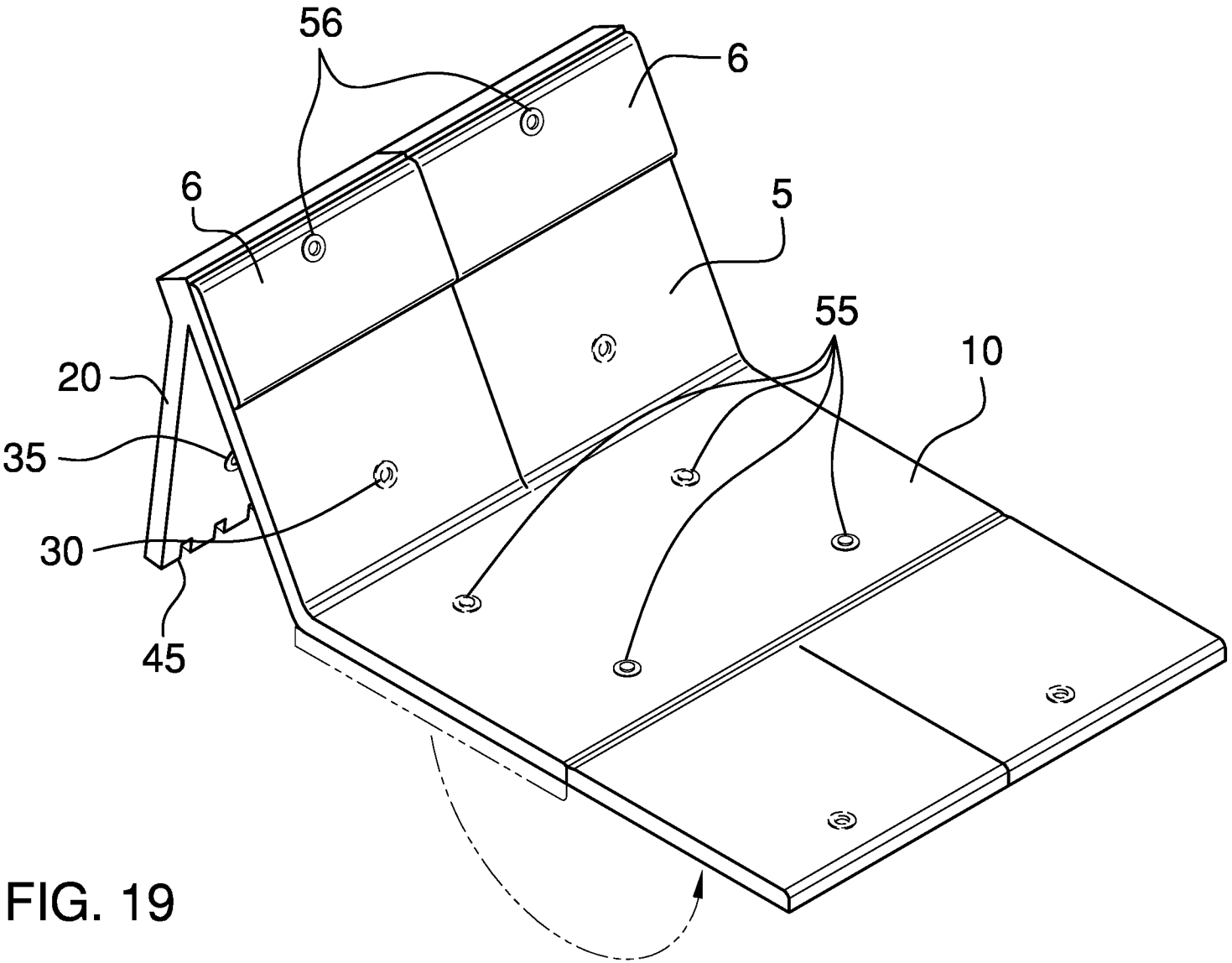
FIG. 19 is a front isometric view with the extensions out of the fifth embodiment.
Figure 20:
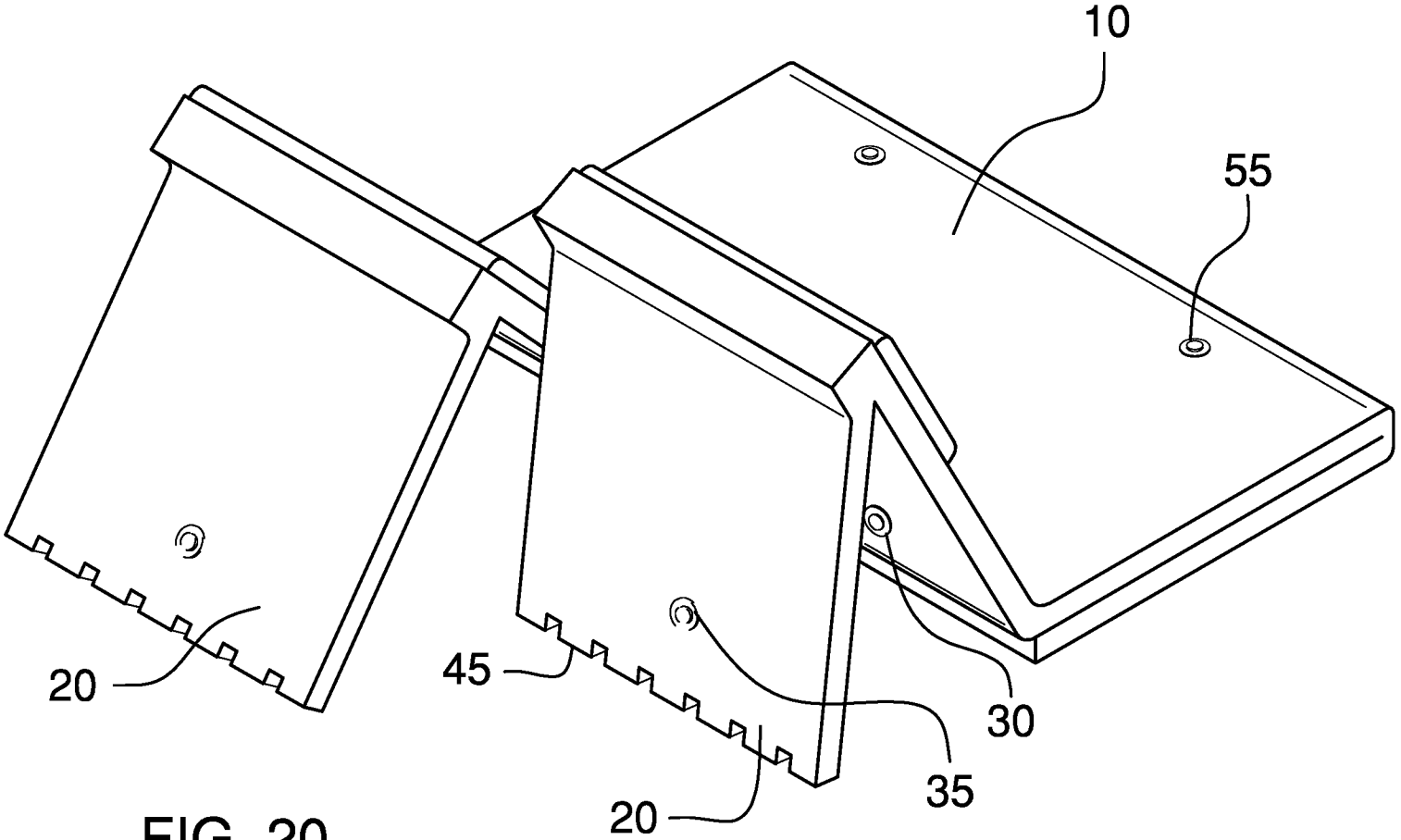
FIG. 20 is a back isometric view of the fifth embodiment.
Figure 21:
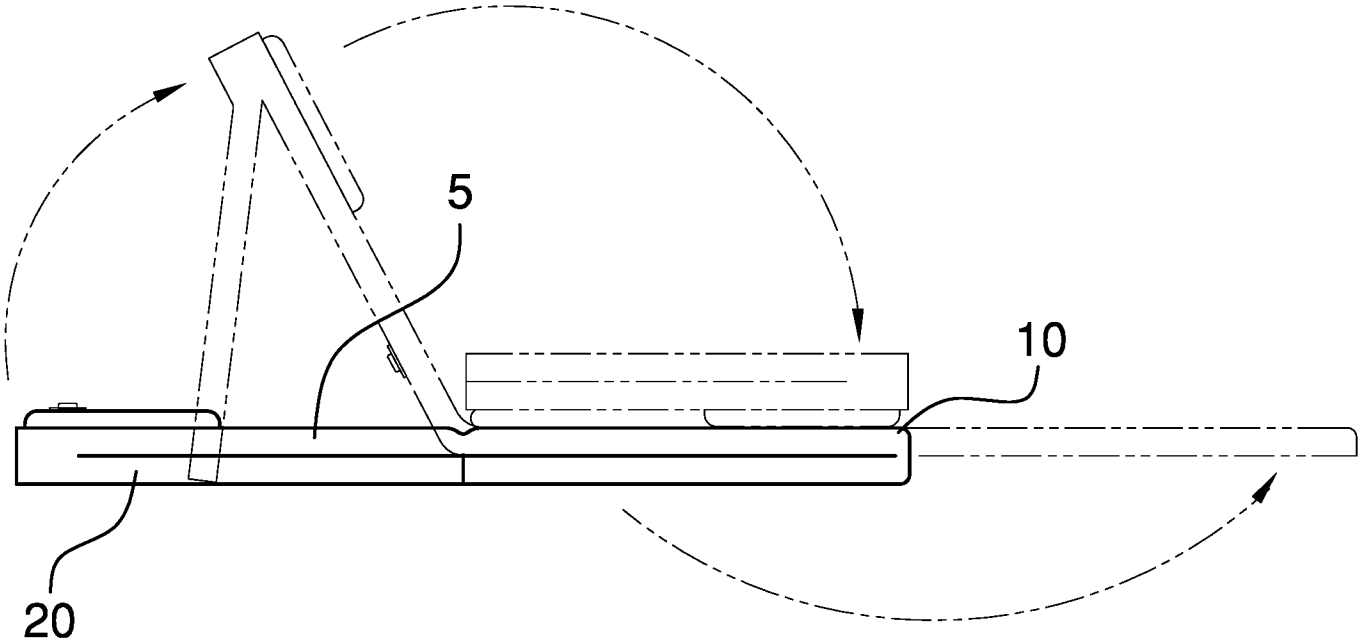
FIG. 21 is a side view showing different backrest positions of the fifth embodiment.
Figure 22:
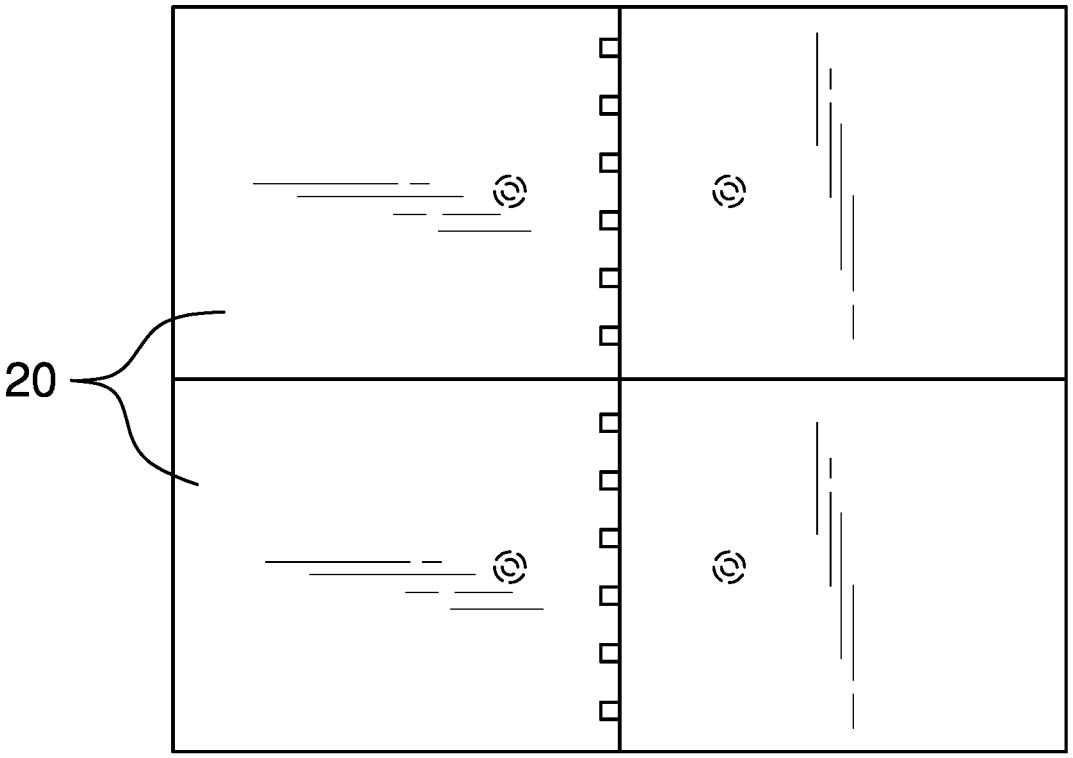
FIG. 22 is a bottom view showing the seat with the extensions and balancers Closed in the fifth embodiment.
Figure 23:
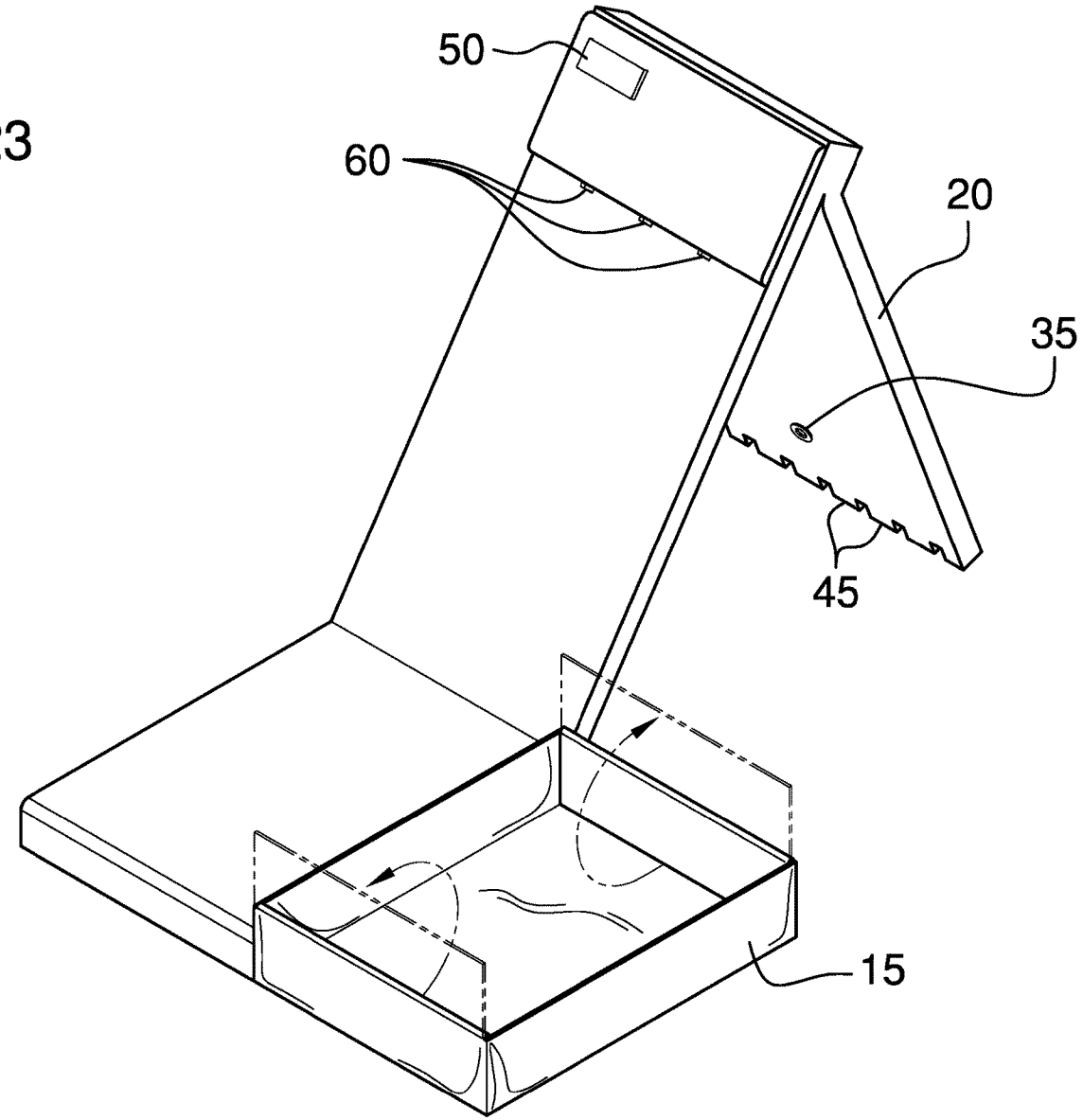
FIG. 23 is a front isometric view of the sixth embodiment.

On the base member 25 will be a seat 10 and two backrest 5 and two headrests 6; the two backrest sections 5 will operate independently of each other during normal use. At the junction of the seat 10 and the backrest 5 the material is flexible such that the headrest may bend to form an inclined surface such as depicted in FIG. 18.

A balancer 20 is provided to stabilize the backrest section; the balancer is adjustable to accommodate the desire of the user.

A variety of snap locks will be utilized to fold the device to permit the device to be carried from location to location.

Sixth Embodiment

A sixth embodiment is depicted by FIGS. 23 through 26. The sixth embodiment teaches a base 25 that is made of the same material as the other four previously described embodiments. The base 25 is a flat member with a first end and a second end. At the end of the first end is a seat 10 and a headrest 6 is at the second end. A backrest 5 is positioned between the seat 10 and headrest 6. The portion of the mat between the backrest 5 and the seat is flexible to provide an inclined surface upon which a person can recline.

A balancer 20 is placed on the opposite surface of the backrest 5; the balancer is also flexible and can be bent away from the back surface of the headrest at a variety of angles. On the base member a plurality of notches 26 are provided.

Figure 24:
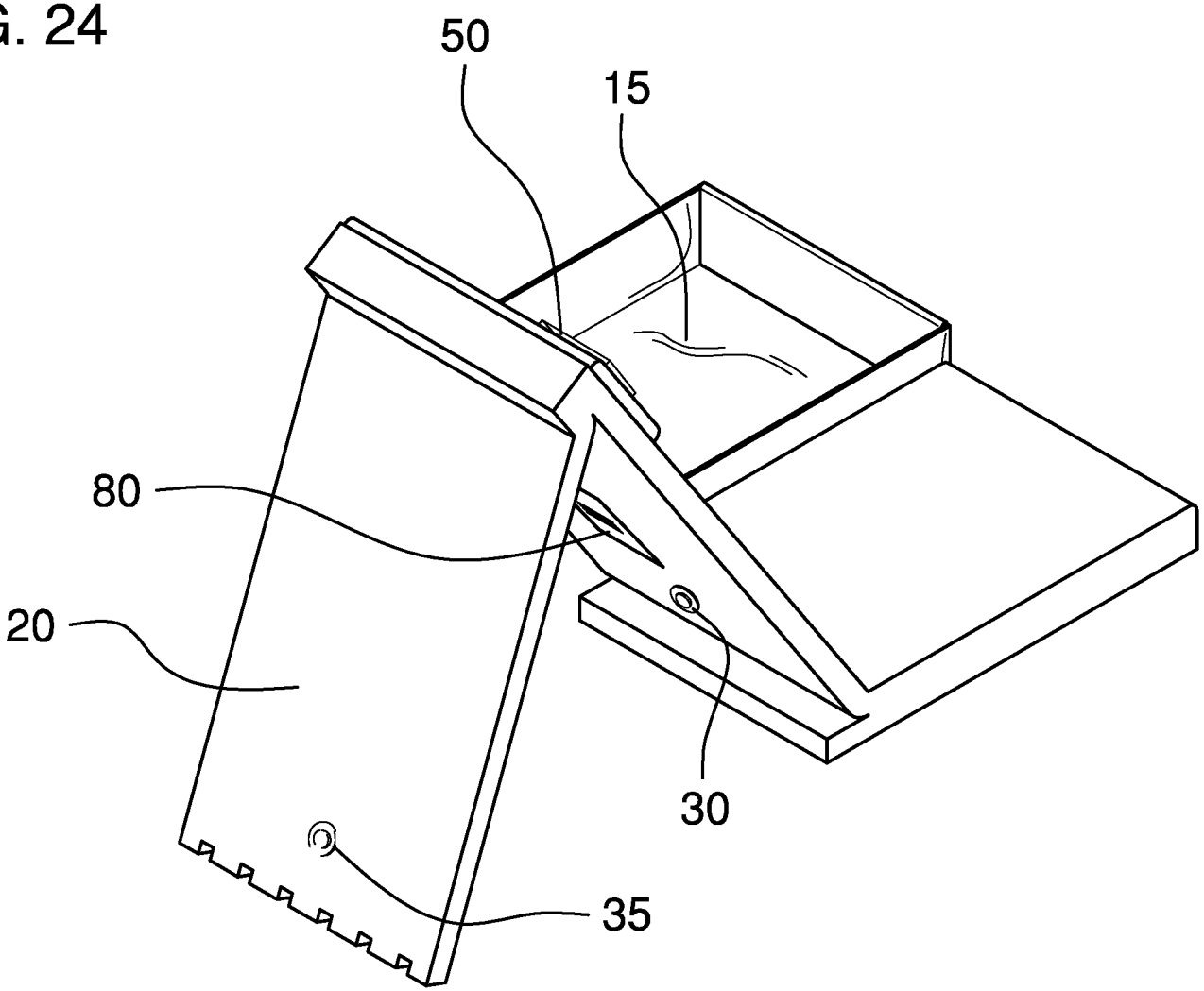
FIG. 24 is a back isometric view of the sixth embodiment.
Figure 25:
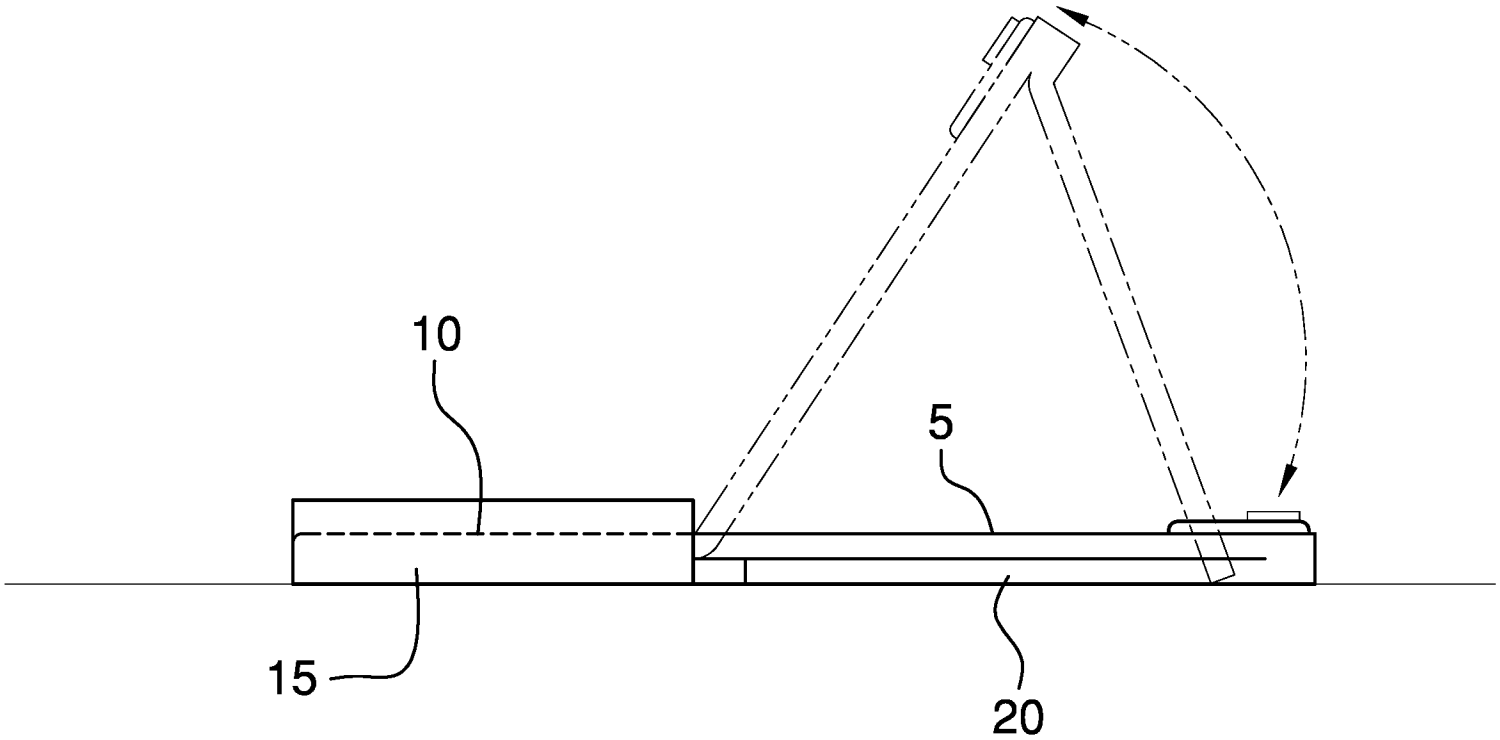
FIG. 25 is a side view showing different backrest positions of the sixth embodiment.
Figure 26:
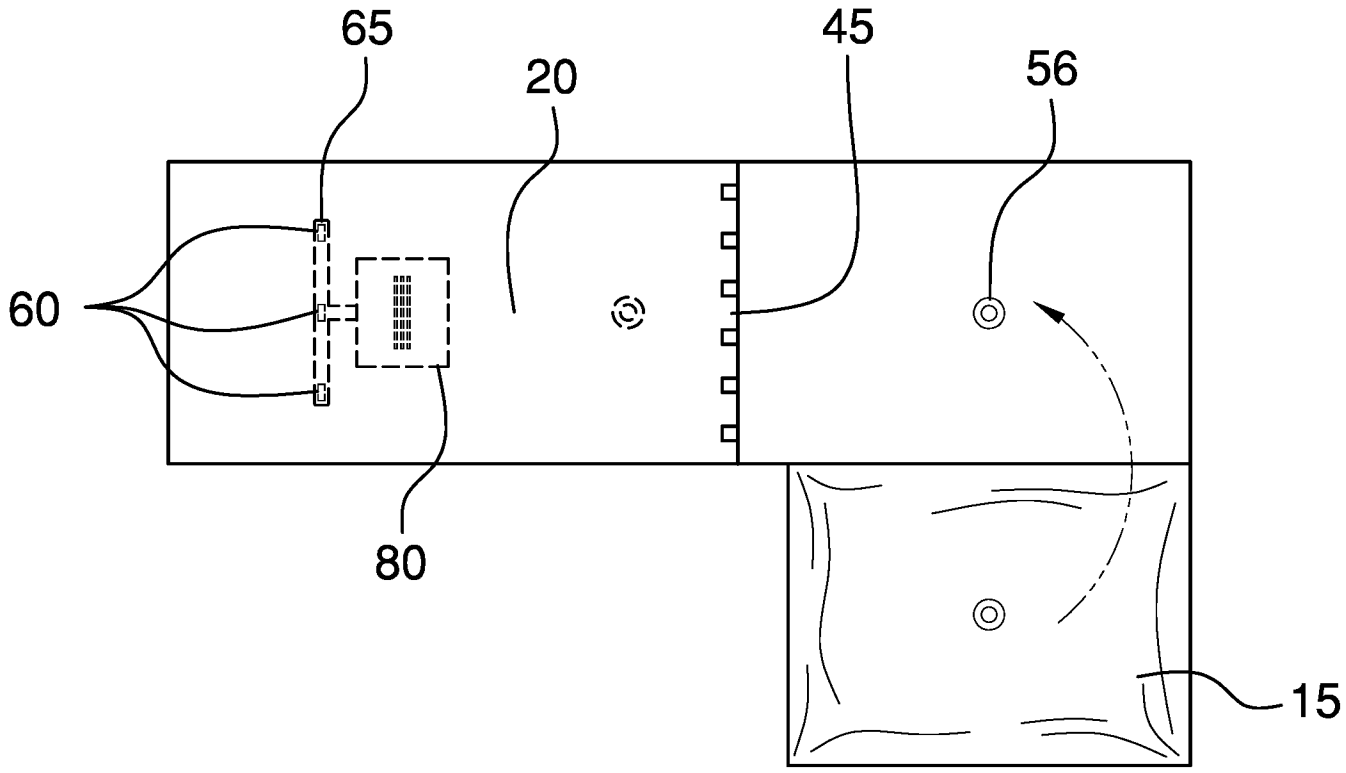
FIG. 26 is a bottom view showing the balancer closed and the compartment that is attached to the chair in the sixth embodiment.
Figure 27:
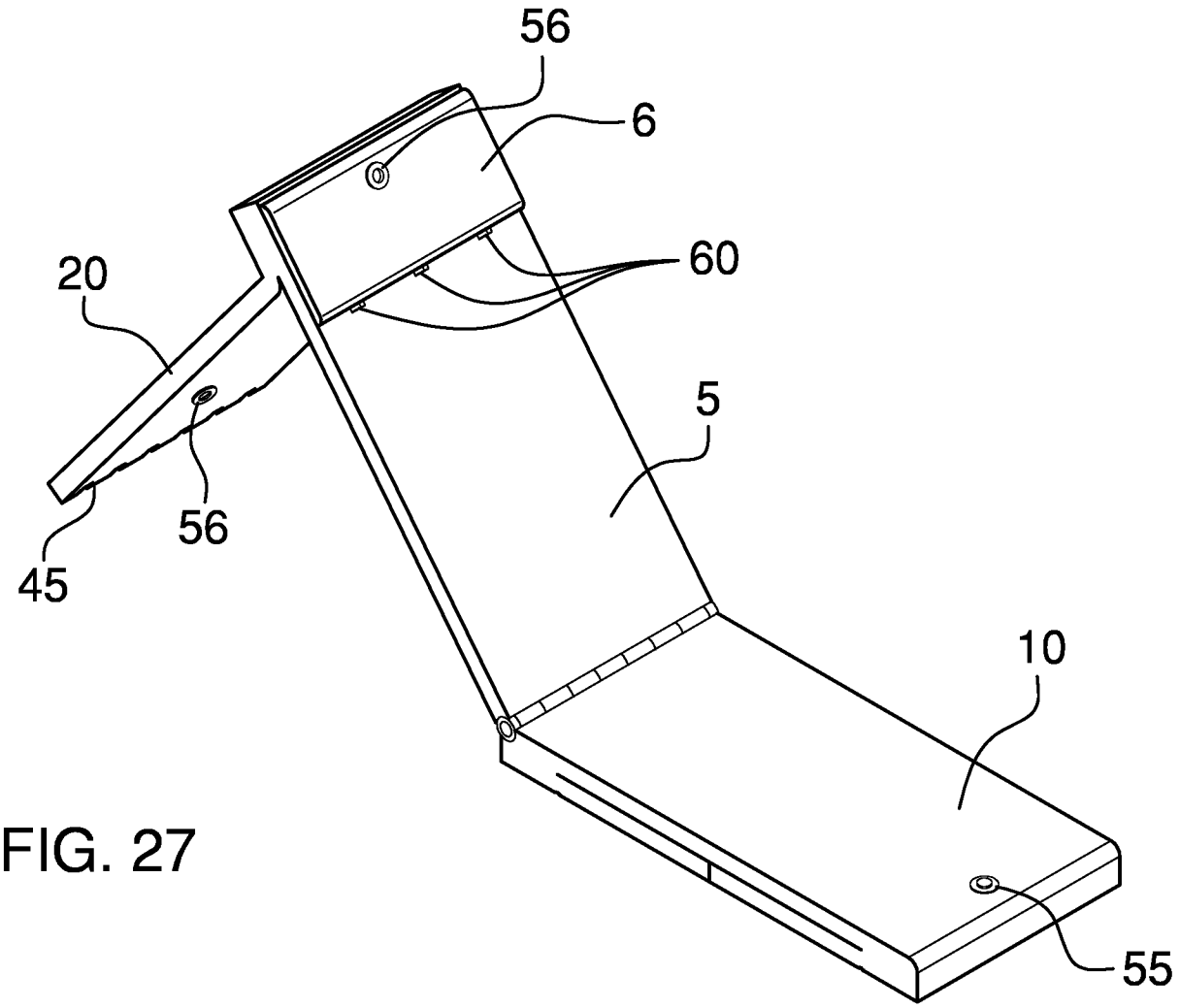
FIG. 27 is a front isometric view of the seventh embodiment.

On the back surface of the backrest an air conditioner unit 80 will be provided as depicted in FIG. 24. A power source will be provided. Possible power sources may include solar power, alternating current or direct current. The placement of the air conditioning unit 80 will be positioned such that it is placed with the comfort of the user in mind. Outflow vents 60 will connect the air conditioner unit to the device. A cell phone compartment 50 will also be provided on the headrest 6.

A plurality of male snap locks 55 and female snap locks 56 are provided to allow the easy transport of the device and prevent the device from unfolding during transport. A storage compartment 15 is attached to a portion of the base member. A lid is provided to protect the items in the storage compartment.

Seventh Embodiment

Figure 28:
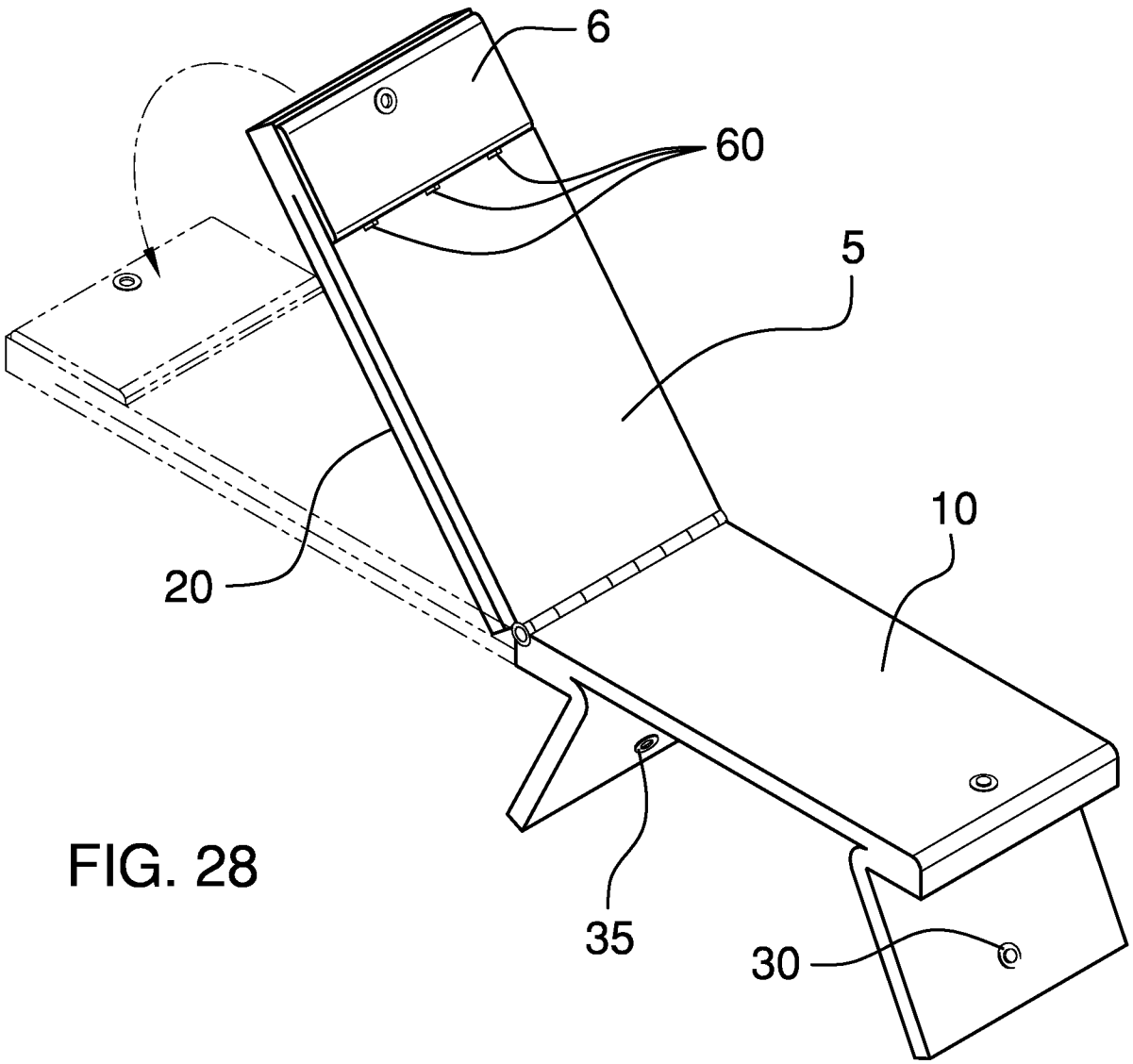
FIG. 28 is a front isometric view depicting the portion on the back side of the seat folded outward to form a pair of legs in the seventh embodiment.
Figure 29:
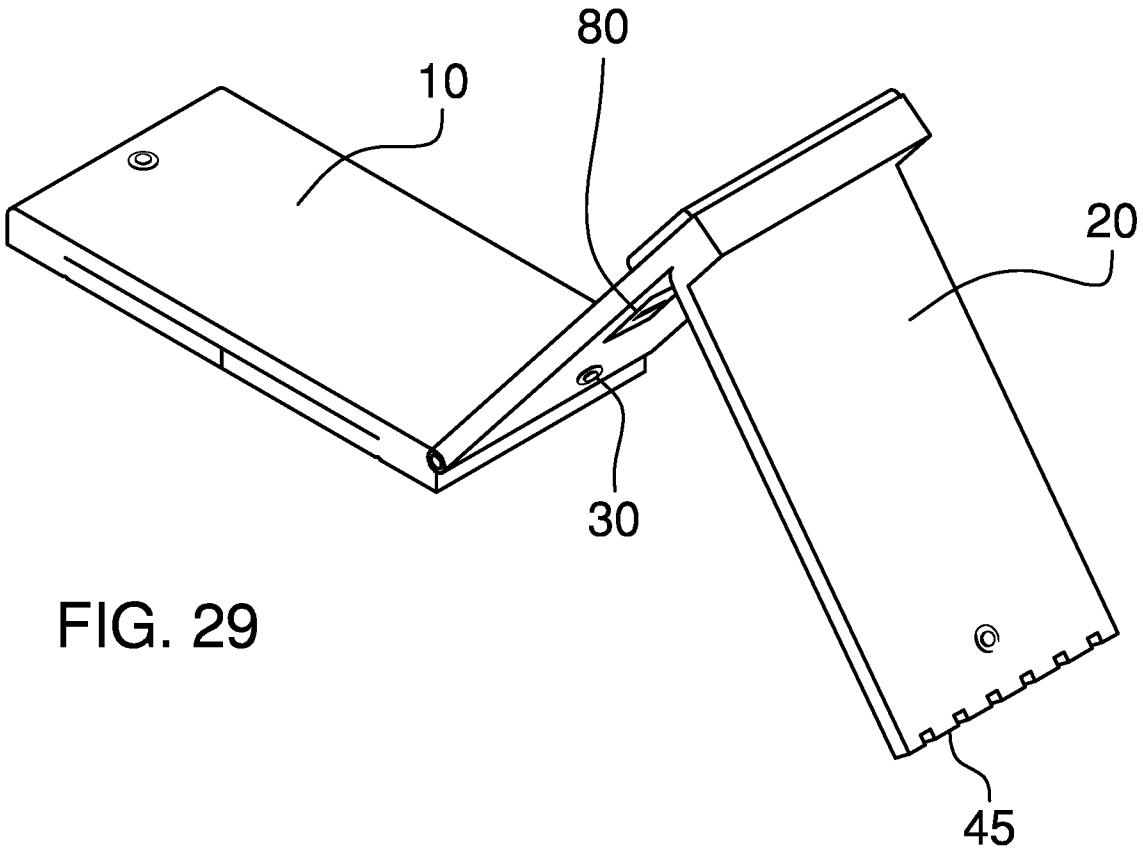
FIG. 29 is a back isometric view with the legs folded against the back side of the seat portion and the balancer folded outward to form the inclined surface of the seventh embodiment.
Figure 30:
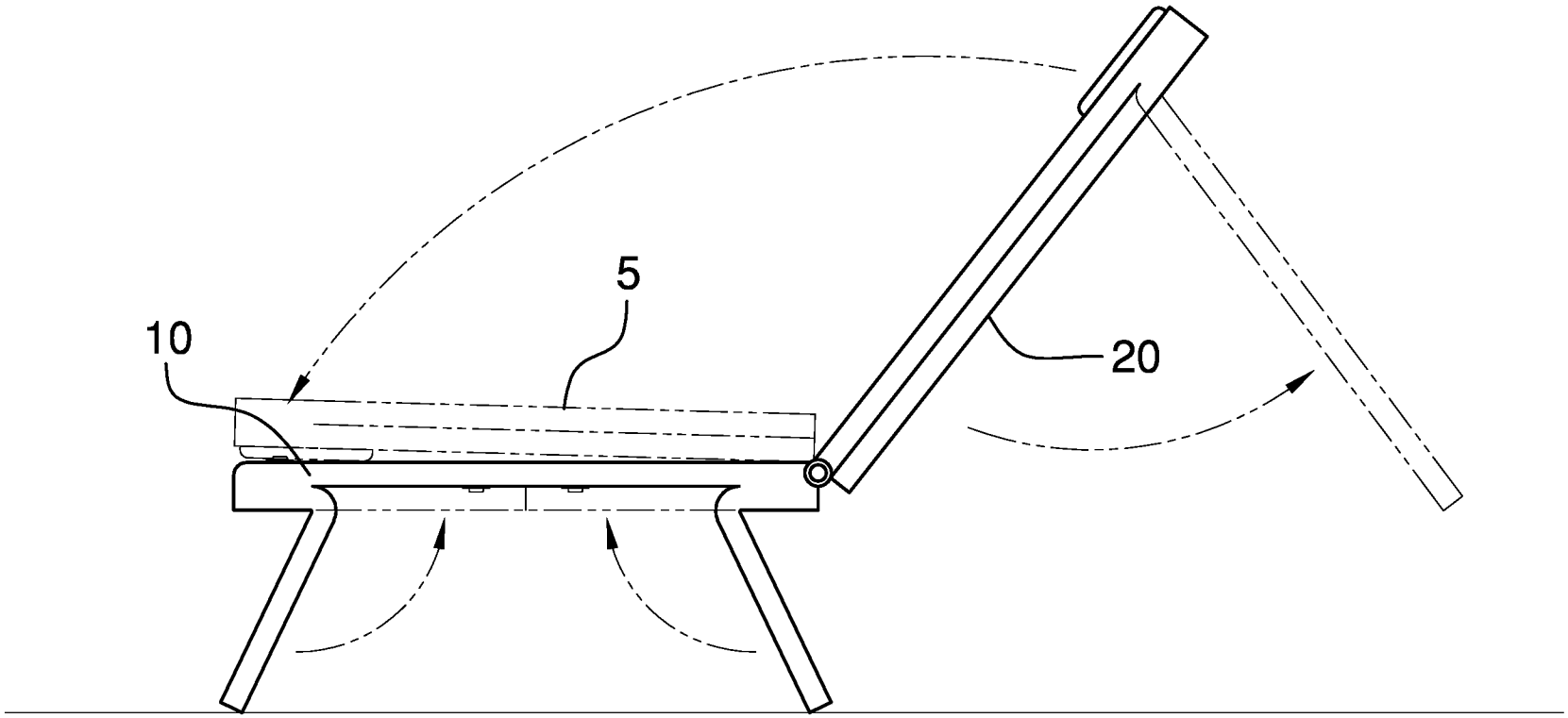
FIG. 30 is a side view showing different backrest positions at the seventh embodiment.

A seventh embodiment is depicted by FIGS. 27 through 31. The seventh embodiment teaches a flat planar surface with a seat 10 and a backrest section 5 and a headrest 6 that are connected by a hinge. The seat has a top surface and a bottom surface; the individual who is using the item will lay on the top surface. On the bottom surface of the seat 10 are a plurality of legs 31 that are flexible and fold into legs that support the seat portion such as depicted in FIGS. 28 and 30. This embodiment allows the device to be elevated off the ground.

Figure 31:
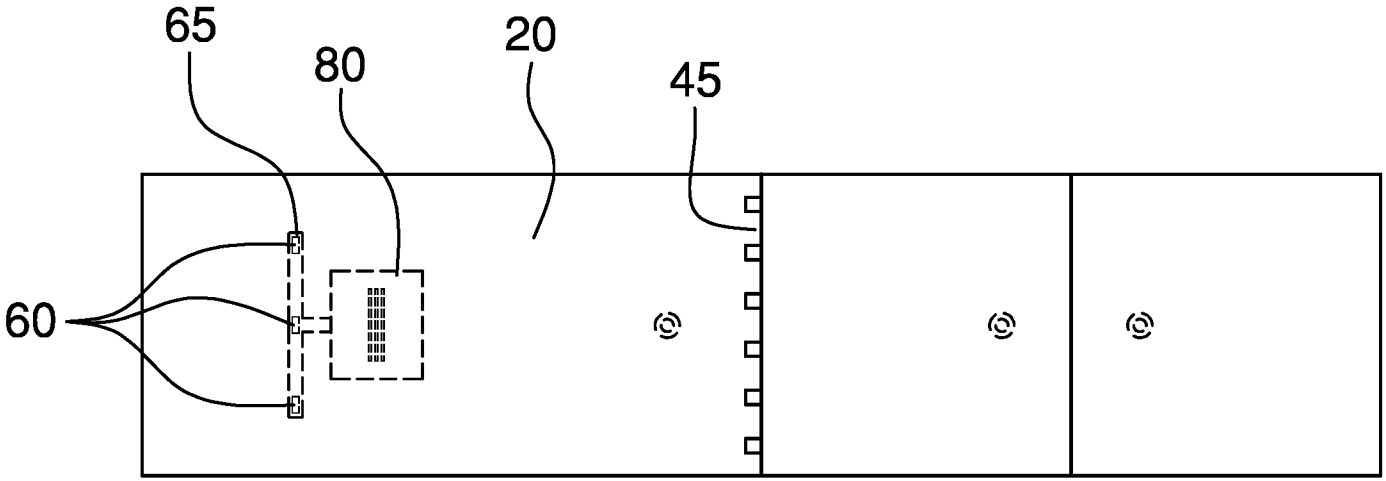
FIG. 31 is a bottom view showing the seat with the legs and balancer closed in the seventh embodiment.

The hinge that is depicted in FIG. 28 separate the seat 10 from the backrest portion 5. On the back surface of the backrest 5 an air conditioner unit 80 will be provided such as depicted in FIG. 31. On one edge of the backrest are a plurality of outflow vents 60, which connect the air conditioner unit to the device.

A balancer 20 is placed on the opposite surface of the backrest 5; the balancer 20 is also flexible and can be bent away from the back surface of the headrest at a variety of angles. On the base member a plurality of notches 45 are provided.

Possible power sources for the air conditioner may include solar power, alternating current or direct current. The placement of the air conditioning unit 80 will be positioned such that it is placed with the comfort of the user in mind.

A plurality of male snap locks 55 and female snap locks 56 are provided to allow the easy transport of the device and prevent the device from unfolding during transport.

The inventor claims:

1. A collapsible chair which is comprised of:
a backrest;
a balancer;
wherein the balancer is integral to the device;
wherein the balancer is foldable;
a base;
wherein the base is a predetermined shape;
a headrest;
a storage compartment;
wherein the storage compartment is a predetermined shape;
wherein the storage compartment is placed on one end of the base;
wherein a lid is provided on the storage compartment;
wherein the balancer can flex;
a plurality of male snap locks;
a plurality of female snap locks;
wherein the storage compartment is of a predetermined shape,
wherein the lid is hinged to one end of the storage compartment
wherein the lid can rotate upward.

2. A collapsible chair which is comprised of:
a backrest;
a balancer;
wherein the balances has a first end and a second end;
wherein the first end of the balancer is integral to the device;
wherein a portion of the balancer is foldable;
wherein a plurality of square spikes are provided on the second end of the balancer;
a headrest;
a seat;
a lip;
wherein the lip is on the first end of the base;
wherein the lip is semi-rigid;
a strap;
a male snap lock;
a female snap lock.

3. A collapsible chair which is comprised of:
a seat;
a backrest;
a headrest;
a cell phone compartment;
an air conditioning unit;
a plurality of outflow vents;
a balancer;
a plurality of square spikes;
wherein the balancer has a plurality of square spikes;
a female snap lock;
a male snap lock.

4. A collapsible chair which is comprised of:
a base;
a backrest;
a seat;
wherein the backrest is flexible at the junction of the seat;
a headrest;
an air conditioner unit;
wherein the air conditioner unit is embedded on the back surface of the backrest;
a plurality of outflow vents;
a balancer;
wherein the balancer has a first end and a second end;
wherein the balancer is positioned on the back surface of the backrest;
wherein the balancer has a first end and a second end;
wherein the balancer is rigid;
a cell phone compartment;
a female snap lock;
a male snap lock;
a plurality of notches on the base member;
wherein the first end of the balancer is placed within a notch on the base.

5. A collapsible chair which is comprised of:
a base;
a pair of backrest sections;
wherein the two backrest sections operate independently of each other;
a seat;
wherein the backrest is flexible at the junction of the seat;
a pair of headrests;
a pair of balancers;
wherein the pair of balancers are positioned on the back surface of the backrest;
wherein the pair of balancers has a first end and a second end;
wherein the pair of balancers are rigid;
wherein the pair of balancers operate independently of each other;
a plurality of female snap locks;
a plurality of male snap locks.

6. A collapsible chair which is comprised of:
a base;
a backrest section;
a seat;
wherein the backrest is flexible at the junction of the seat;
a balancer;
wherein the balancer has a first end and a second end;

wherein a plurality of notches is provided on the first end of the balancer;
wherein the balancer is rigid;
wherein the balancer can rotate near the top surface of the underside of the backrest portion;
an air conditioning unit;
wherein a power source is provided for the air conditioning unit;
a plurality of outflow vents;
a cell phone compartment;
a storage compartment;
wherein the storage compartment is adjacent to the seat of the device;
a plurality of female snap locks;
a plurality of male snap locks.

7. A collapsible chair which is comprised of:
a base;
a backrest section;
a seat;
wherein the seat had a first side and a second side
a pair of legs is provided on the second side of the seat;
wherein the legs can rotate outward to form a base for the seat;
a hinge;
wherein the hinge is between one end of the backrest section and one end of the seat section;
a balancer;
wherein the balancer has a first end and a second end;
wherein a plurality of notches is provided on the first end of the balancer;
wherein the balancer is rigid;
wherein the balancer can rotate near the top surface of the underside of the backrest portion;
an air conditioning unit;
wherein a power source is provided for the air conditioning unit;
a plurality of outflow vents;
a cell phone compartment;
a storage compartment;
wherein the storage compartment is adjacent to the seat of the device;
a plurality of female snap locks;
a plurality of male snap locks.

* * * * *